US005560596A

United States Patent [19]

Okoda et al.

[11] Patent Number: 5,560,596

[45] Date of Patent: Oct. 1, 1996

[54] SHEET SUPPLYING DEVICE AND RECORDING OR READING APPARATUS

[75] Inventors: Keiji Okoda; Kazuhiro Matsumoto, both of Yokohama, Japan

[73] Assignee: Canon Kabushiki Kaisha, Tokyo, Japan

[21] Appl. No.: 288,193

[22] Filed: Aug. 9, 1994

[30] Foreign Application Priority Data

Aug. 10, 1993 [JP] Japan ..... 5-216905
Sep. 10, 1993 [JP] Japan ..... 5-249972

[51] Int. Cl.[6] ..... B65H 3/46

[52] U.S. Cl. ..... 271/106; 271/107

[58] Field of Search ..... 271/5, 11, 107, 271/104, 106, 100, 102; 221/211

[56] References Cited

U.S. PATENT DOCUMENTS 4,759,679 7/1988 Muller ..... 271/5 X
4,767,113 8/1988 Hasegawa et al. ..... 271/5 X
5,427,365 6/1995 Torisawa ..... 271/107 X

FOREIGN PATENT DOCUMENTS 4123188 1/1992 Germany ..... 271/107
1-122841 5/1989 Japan ..... 271/11
4-64537 2/1992 Japan ..... 271/11

*Primary Examiner*—David H. Bollinger
*Attorney, Agent, or Firm*—Fitzpatrick, Cella, Harper & Scinto

[57] ABSTRACT

Disclosed is a sheet supplying device having a suction unit unit for sucking a sheet, and a suction unit unit sucker moving device for moving the suction unit unit, the suction unit unit moving device having a diametrically moving mechanism for moving the suction unit unit diametrically of a predetermined rotary shaft, and a circumferentially moving mechanism for moving the suction unit unit circumferentially of the rotary shaft. Also disclosed is an image recording or reading apparatus for recording an image on a sheet supplied by the use of such sheet supplying device or reading an image from the sheet.

17 Claims, 35 Drawing Sheets

SHEET SUPPLYING DEVICE AND RECORDING OR READING APPARATUS

BACKGROUND OF THE INVENTION

1. Field of the Invention

This invention relates to a sheet supplying device for supplying, for example, sheets to an image recording apparatus or an image reading apparatus, and a recording or reading apparatus for recording images on the sheets supplied by the use of the sheet supplying device or reading images from the sheets.

2. Related Background Art

Sheet supplying devices have heretofore been widely used in image recording apparatuses, image reading apparatuses and other various apparatuses, and various kinds of structure and method thereof are known. As shown, for example, in FIGS. 1A and 1B of the accompanying drawings, a sheet supplying device 1 is disposed above a supply magazine 2 in which a number of film sheets F are piled, and the film sheets F are fed one by one to a pair of rollers 4 while being sucked by a suction unit 3, and is further fed to an image recording or reading apparatus, not shown. The sucker 3 is mounted on a slide bed 5 installed for movement to right and left, through arms 6, 7 and a hinge 8, the arms 6, 7 being engaged with a guide slot 10 in the slide bed 5 through a guide pin 9. The guide slot 10 comprises an upper guide slot 10*a* and a lower guide slot 10*b*, and by a guide bar 11 being changed over, the guide pin 9 is guided to a desired side of the guide slots 10*a* and 10*b*. When the guide pin 9 is guided to the guide slot 10*b*, the suction unit 3 is moved toward the film sheets F, and when the guide pin 9 is guided to the guide slot 10*a*, the suction unit 3 is moved toward the pair of rollers 4.

The sheet supplying device in which the suction unit 3 is thus moved by the utilization of a link mechanism to thereby convey the film sheets F to the pair of roller 4 is often used, and besides this, there is a sheet supplying device which utilizes a cam mechanism.

However, the above-described example of the prior art suffers from the following problems.

(a) Where a link mechanism is utilized, the degree of freedom of the movement of the suction unit 3 is small and therefore, the range of movement of the suction unit 3 must be limited and the pair of roller 4 must be installed near the supply magazine 2. Also, the direction in which the film sheet F is inserted into the nip between the pairs of rollers 4 must be made substantially coincident with the direction of the piled film sheets F and therefore, when a device is supposed which conveys the film sheet F to the image recording or reading apparatus while changing its direction, a number of pairs of rollers 4 and guide plates will be required, and this will lead to the bulkiness of the entire device 5 and increased cost.

(b) Where a cam mechanism is utilized, the range of movement of the suction unit 3 can be widened, but this will lead to the complication and bulkiness of the entire device.

SUMMARY OF THE INVENTION

It is a first object of the present invention to solve the above-noted problems and to provide a sheet supplying device in which the degree of freedom of conveyance is enhanced with the structure of the device kept simple and compact, and a recording or reading apparatus using such device.

Other objects of the present invention will become apparent from the following detailed description of some embodiments of the invention.

DESCRIPTION OF THE PREFERRED EMBODIMENTS

The present invention will hereinafter be described in detail with respect to some embodiments thereof shown in FIGS. 2A to 43.

Figure 1A:
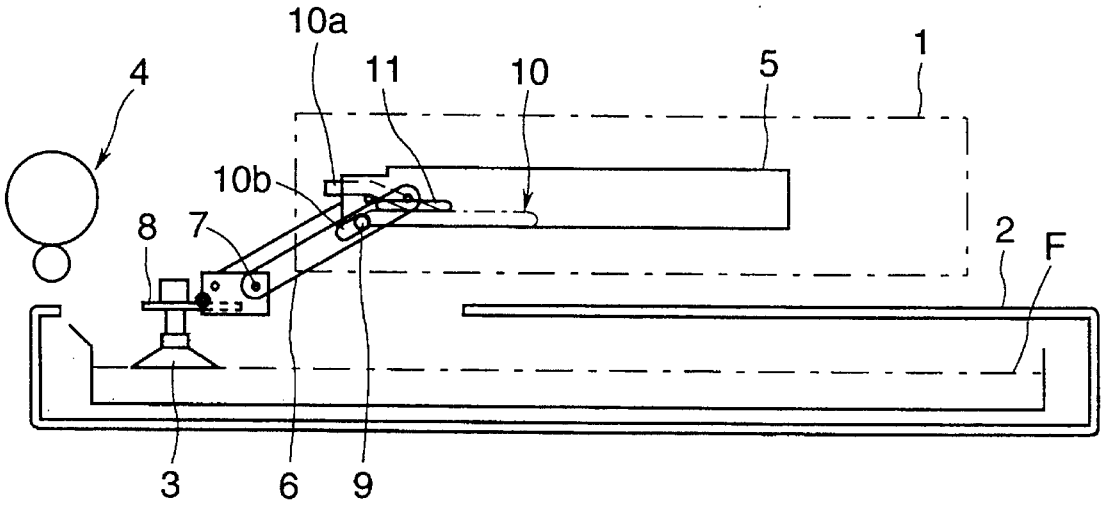
FIG. 1A shows the construction of an example of the prior art.
Figure 1B:
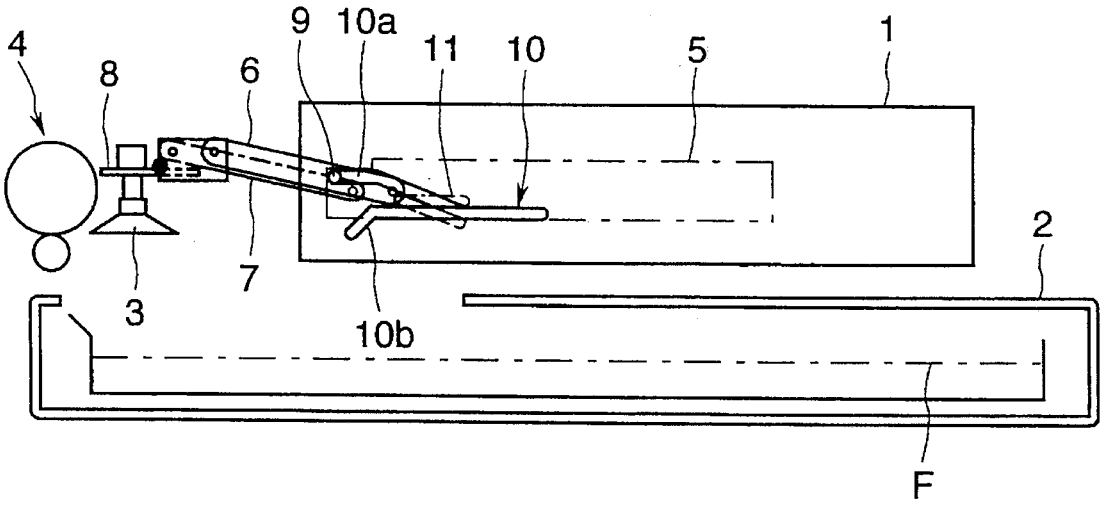
FIG. 1B shows the construction of an example of the prior art.
Figure 2A:
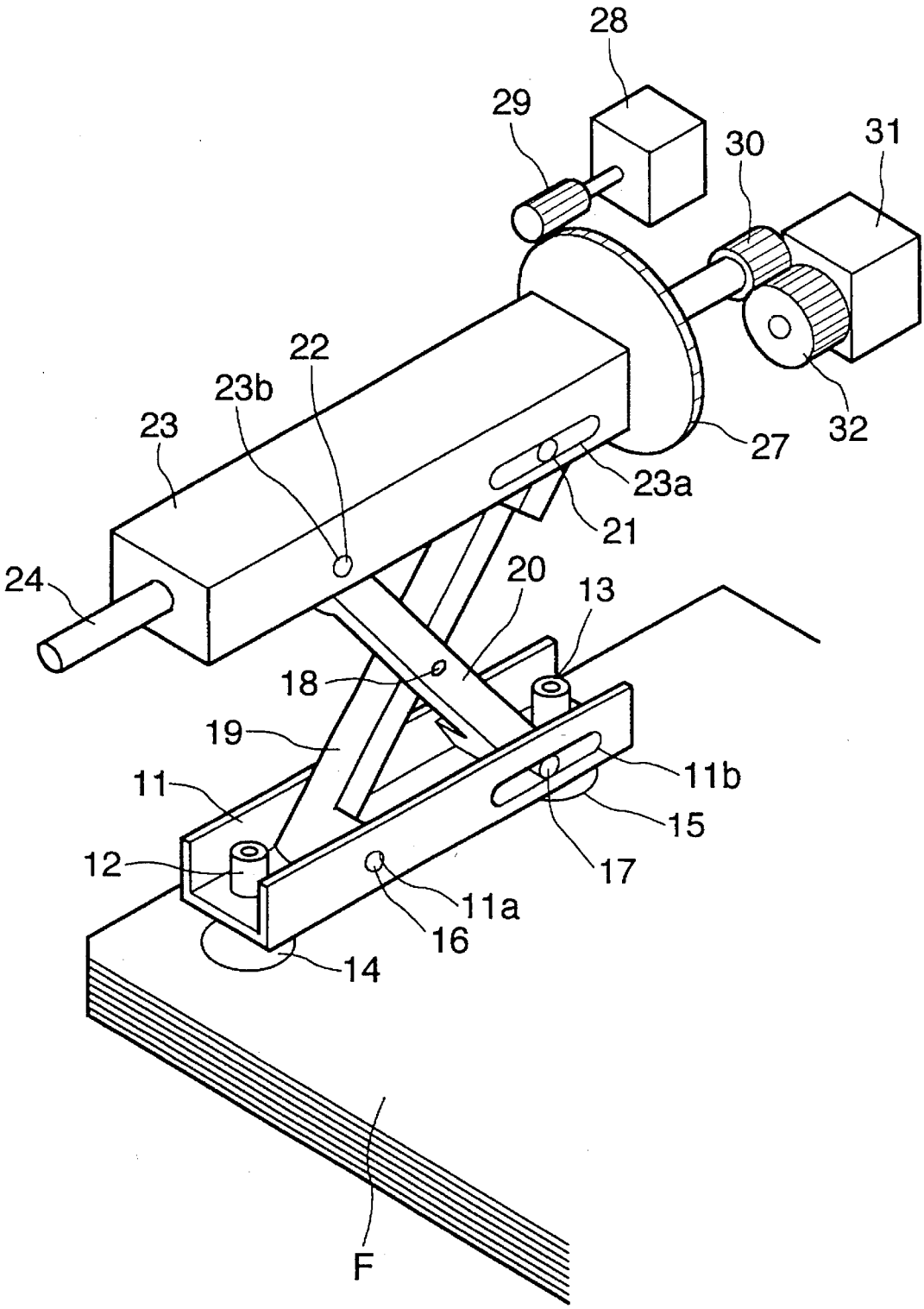
FIG. 2A is a perspective view of a first embodiment of the present invention.
Figure 2B:
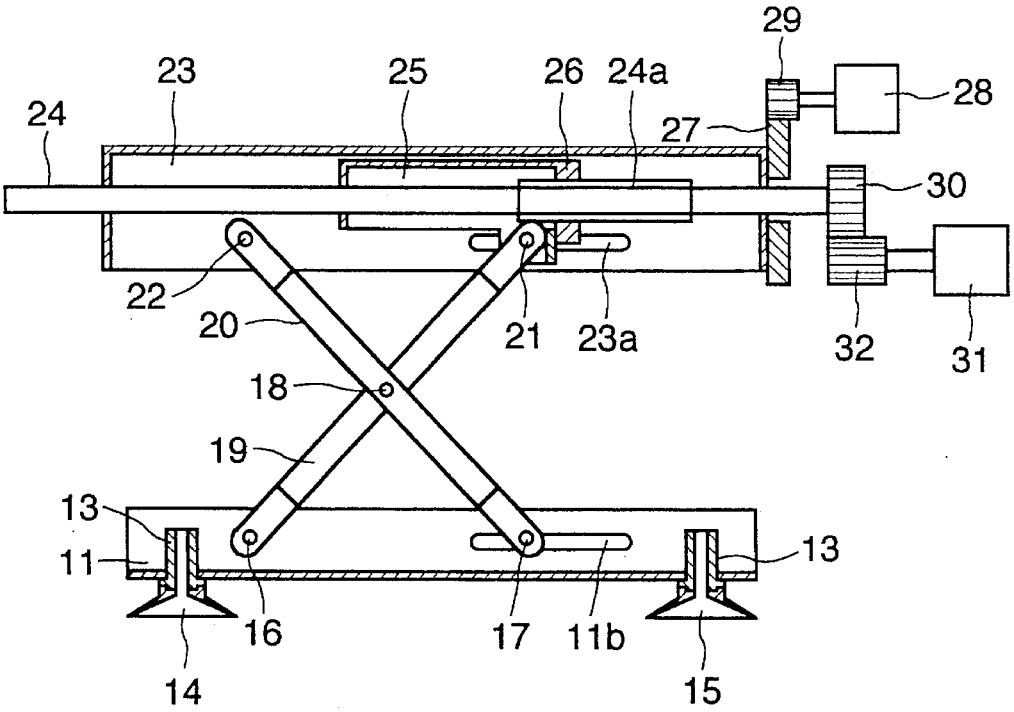
FIG. 2B is a partly cross-sectional view of the first embodiment.

FIG. 2A is a perspective view of a first embodiment of the present invention, and FIG. 2B is a partly cross-sectional view of the first embodiment. Above a number of film sheets F piled, a suction unit holding member 11 of U-shaped cross-section is disposed for vertical movement and for circumferential rotation. Nipples 12 and 13 are fitted and fixed to the bottom wall of the suction unit holding member 11, and suction units 14 and 15 are attached to the lower ends of the nipples 12 and 13, respectively. The upper ends of the nipples 12 and 13 are connected to a vacuum pump, not shown, through flexible tubes. A pin holding hole 11*a* and a pin guide hole 11*b* opposed to each other are formed in the both side walls of the suction unit holding member 11, a pin 16 is rotatably inserted in the pin holding hole 11*a*, and a pin 17 is rotatably and slidably inserted in the pin guide hole 11*b*.

The lower ends of arms 19 and 20 rotatably cruciformly-supported by a pin 18 are coupled to the pins 16 and 17, respectively. The upper ends of the arms 19 and 20 are held by an arm supporting member 23 through respective pins 21 and 22. Again in this case, the pin 21 is rotatably and slidably inserted in pin guide holes 23*a* formed in the both side walls of the arm supporting member 23 in opposed relationship with each other, and the pin 22 is rotatably inserted in a pin holding hole 23*b*. Thereby, the suction unit holding member 11 is supported parallel to the arm supporting member 23 and is supported for movement toward and away from the arm supporting member 23.

Such an arm supporting member 23 is through-supported by a rotatable shaft 24 which is rotatably supported by a frame, not shown. A slider 25 is axially slidably through-supported on the rotatable shaft 24. A nut 26 fixed to one end of the slider 25 is threadably engaged with a threaded portion 24*a* formed on the rotatable shaft 24. The lower portion of the slider 25 is connected to the pin 21 inserted in the pin guide holes 23*a*. A gear 27 is fixed to one end of the arm supporting member 23 and is in meshing engagement with the gear 29 of a first drive source 28. A gear 30 is fixed to one end of the rotatable shaft 24 and is meshing engagement with the gear 32 of a second drive source 31.

Figure 3:
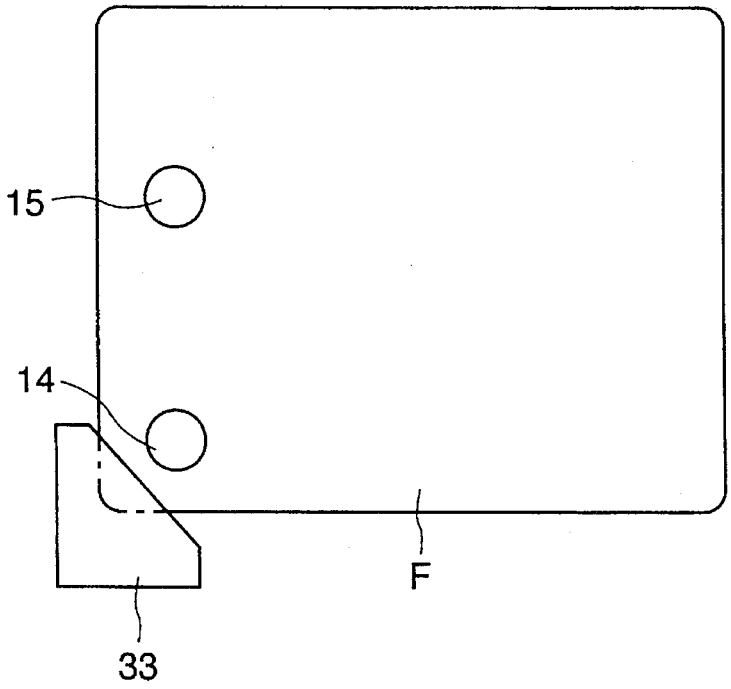
FIG. 3 is a plan view showing the position of a sheet separating pawl.

As shown in the plan view of FIG. 3, a sheet separating pawl 33 is disposed at a corner of the fore end of the piled film sheets F so that the corner of a film sheet F sucked and moved up by the suckers 14 and 15 may be temporarily bent.

With such a construction, when the first drive source 28 is rendered inoperative and the second drive source 31 is operated, the rotatable shaft 24 is rotated and the threaded portion 24*a* thereof is rotated thereby, whereby the slider 25 is moved to right and left with the nut 26. When the slider 25 is moved, the pin 21 slides in the pin guide holes 23*a* and the arms 19 and 20 rotate about the support shaft 18 and thus, the sucker supporting member 11 moves vertically. On the other hand, when both of the first drive source 28 and the second drive source 31 are operated to rotate the rotatable shaft 24 and the arm supporting member 23 at the same angular speed, the suction unit supporting member 11 is rotated about the rotary shaft 24 while keeping its spacing from the rotary shaft 24 constant.

Figure 4:
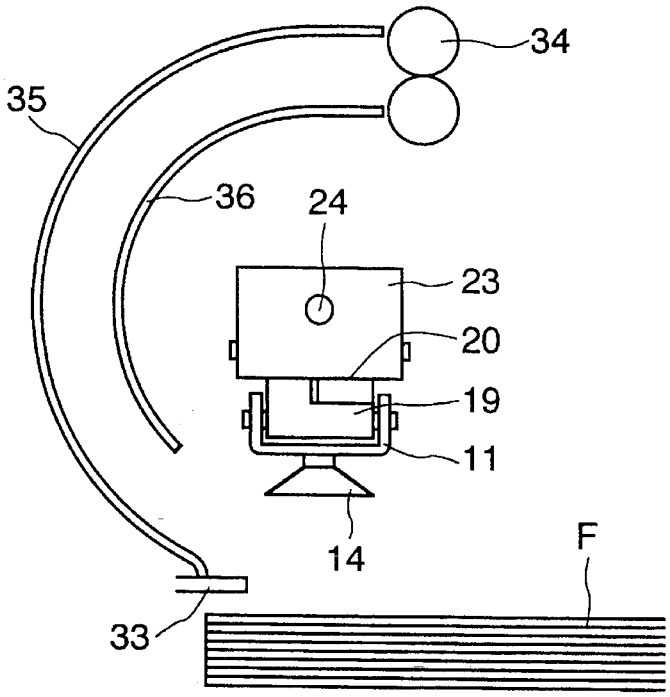
FIG. 4 illustrates the action of the first embodiment.
Figure 5:
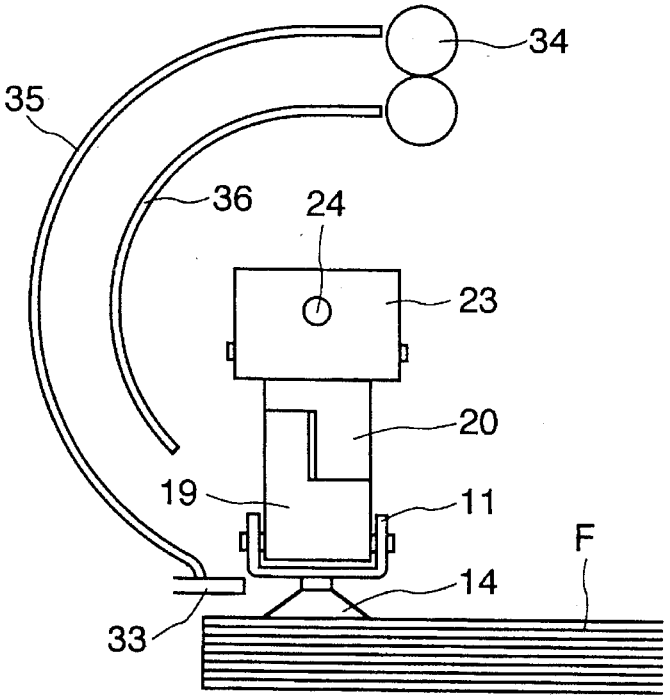
FIG. 5 illustrates the action of the first embodiment.
Figure 6:
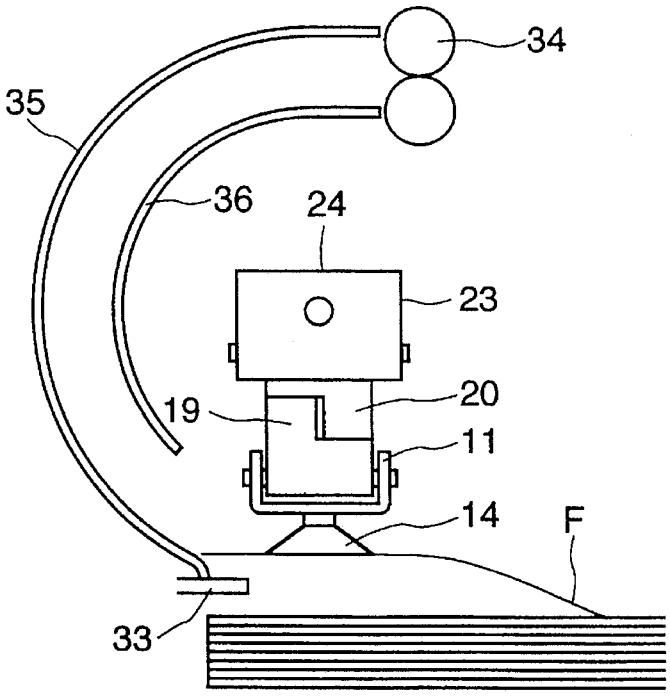
FIG. 6 illustrates the action of the first embodiment.
Figure 7:
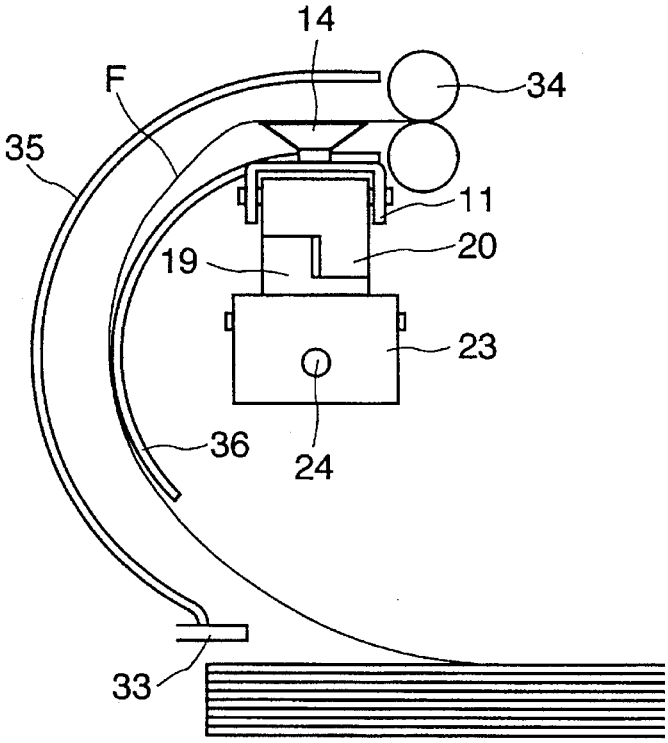
FIG. 7 illustrates the action of the first embodiment.
Figure 8:
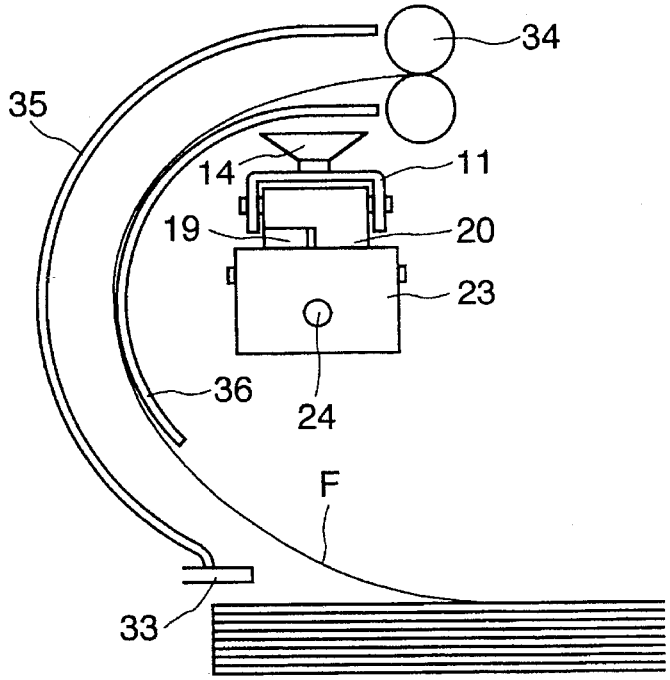
FIG. 8 illustrates the action of the first embodiment.

FIGS. 4 to 8 illustrate the process in which the film sheet F is supplied to a pair of rollers 34. Curved guide plates 35 and 36 are provided between the sheet separating pawl 33 and the pair of rollers 34, and the guide plate 36 is formed with a cut-away, not shown, for passing the sucker supporting 11 and suction unit 14 therethrough. FIG. 4 shows an initial step, and FIG. 5 shows a step at which the suction unit 14 is lowered and comes into contact with the uppermost film sheet F. FIG. 6 shows a step at which the suction unit 14 sucks the film sheet F and raises it to a predetermined position, and a corner of the film sheet F is bent by the sheet separating pawl 33 and only one of the film sheets F is separated. FIG. 7 shows a step at which the suction unit 14 is rotated clockwise with the arm supporting member 23 to thereby the leading end of the film sheet F into the nip between the pair of rollers 34. Finally, FIG. 8 shows a step at which the sucker 14 liberates the film sheet F and retracts to the inside of the guide plate 36. The film sheet F inserted into the nip between the pair of rollers 34 by such steps is conveyed, for example, to an image recording or reading apparatus, not shown, by the pair of rollers 34.

Figure 9:
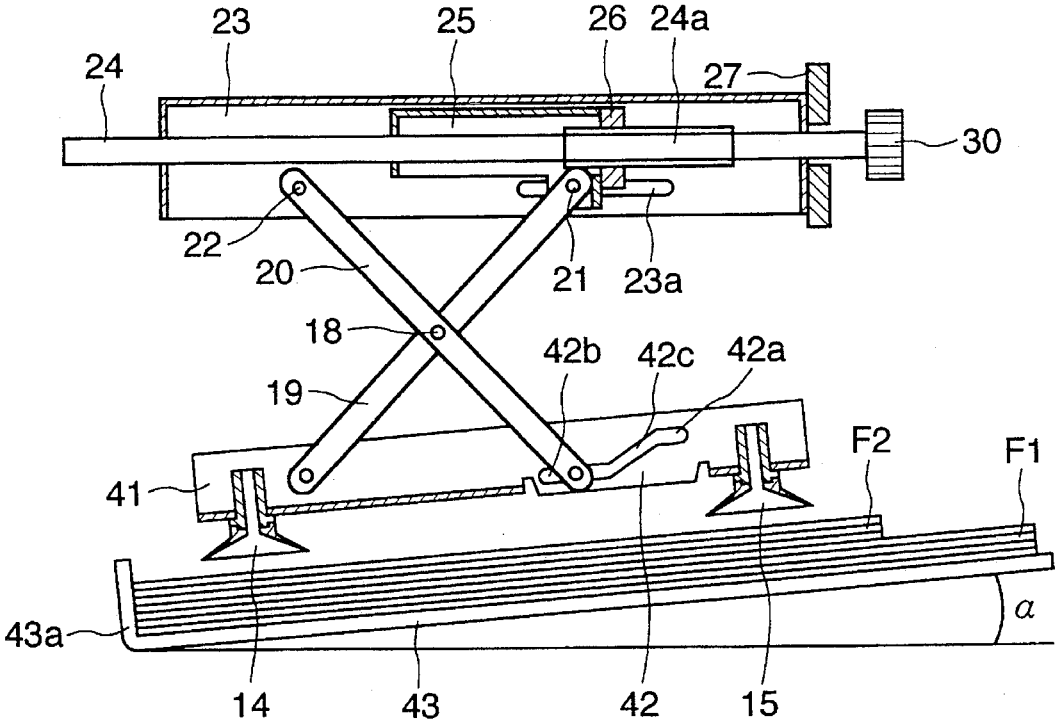
FIG. 9 is a partly cross-sectional view of a second embodiment of the present invention.

Referring now to FIG. 9 which is a partly cross-sectional view of a second embodiment of the present invention, a pin guide hole 42 formed in a suction unit supporting member 41 is formed with an upper-level horizontal portion 42*a*, a lower-level inclined portion 42*b* having an inclination of approximately 5° with respect to the horizontal portion 42*a*, and a connecting portion 42*c*. Thus, the suction unit supporting member 41 becomes parallel to a rotatable shaft 24 in a position in which it is close to the rotatable shaft 24, and becomes inclined with respect to the rotatable shaft 24 in a position in which it is away from the rotatable shaft 24. That is, the sucker supporting member moves up and down while keeping itself parallel to the rotatable shaft 24 when the pin passes the horizontal portion 42*a*, but the sucker supporting member becomes inclined by $\alpha$ from its parallel position when the pin passes the connecting portion 42*c*, and the suction unit supporting member moves up and down while keeping itself so inclined when the pin passes the inclined portion 42*b*. Accordingly, even when the rotatable shaft 24 and a pair of rollers, not shown, are installed horizontally, a supply magazine 43 containing film sheets F therein can be installed with an angle of inclination $\alpha$ with respect to the horizontal position.

Usually, when the supply magazine 43 is installed horizontally and film sheets F1 and F2 differing in length are piled while being in contact with the side wall 43*a* of the supply magazine, during the time when several film sheets F1 and F2 are sucked by suction units 14 and 15 and are conveyed, the remaining film sheets F1 and F2 are moved away from the side wall 43*a* and depart from the operation range of the suction units 14, 15, the pair of rollers and the recording or reading apparatus. In the present embodiment, however, one end of the film sheets is always kept in contact with the side wall 43*a* of the supply magazine 43 and therefore, the film sheets F1 and F2 are supplied stably within the operation range of the suction units 14, 15, the pair of rollers and the recording or reading apparatus.

Figure 10:
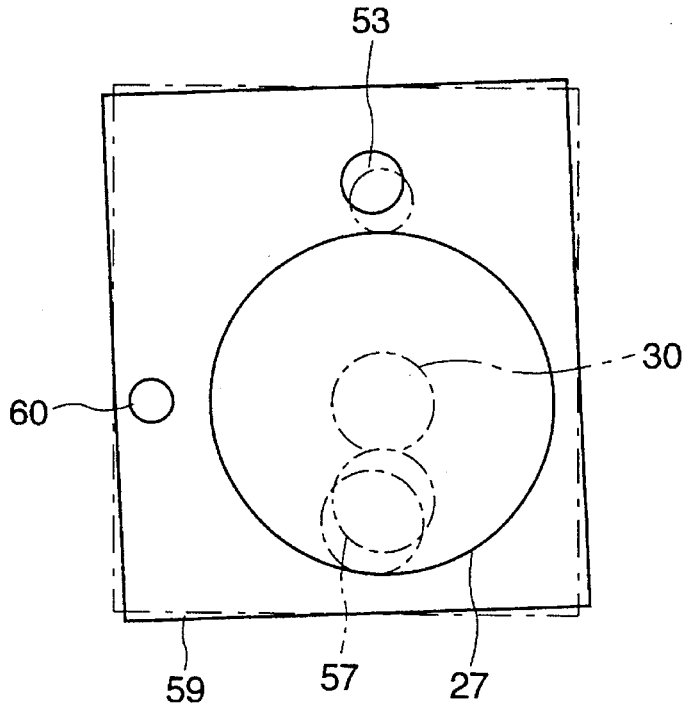
FIG. 10 is a partly cross-sectional view of a third embodiment of the present invention.
Figure 11:
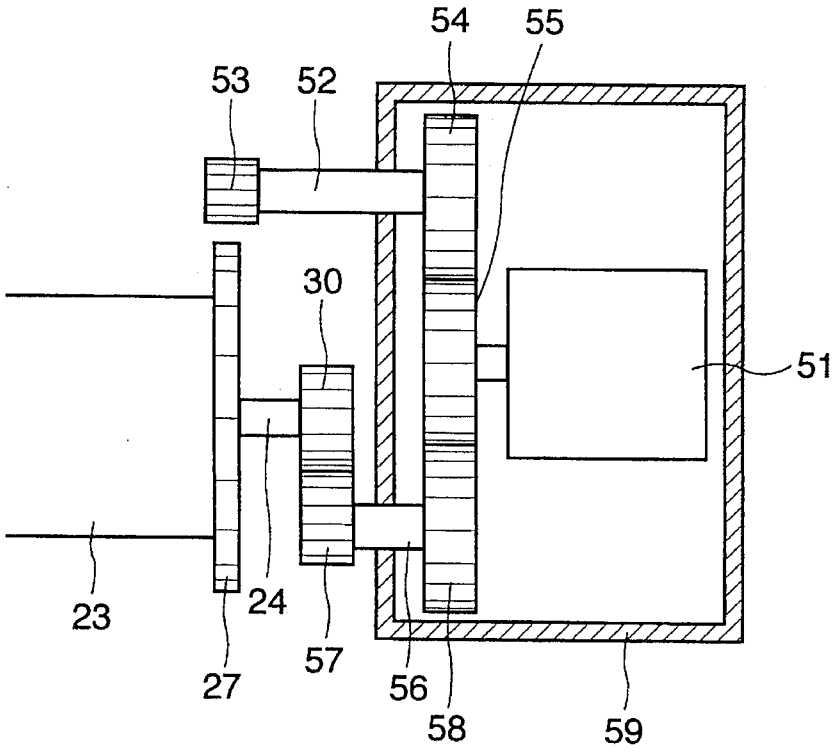
FIG. 11 is a side view of the third embodiment.

FIG. 10 is a partly cross-sectional view of a third embodiment of the present invention, and FIG. 11 is a side view thereof. In this embodiment, the two drive sources 28 and 31 in the first embodiment are replaced by a single drive source 51. The gear 27 of an arm supporting member 23 is in meshing engagement with one gear 53 on a gear shaft 52, and the other gear 54 on the gear shaft 52 is in meshing engagement with the gear 55 of the drive source 51. On the other hand, a gear 30 on a rotatable shaft 24 is in meshing engagement with one gear 57 on a gear shaft 56, and the other gear 58 is in meshing engagement with the gear 55 of the drive source 51. The drive source 51 and gears 54, 55, 58 are contained in a gear box 59, and the gear shafts 52 and 56 are rotatably supported by the gear box 59. Such a gear box 59 can be rotatably connected to the rotatable shaft 60 of an actuator, not shown, and can be fixed at a desired position by a stopper mechanism, not shown. The arm supporting member 23 can also be fixed at a desired position by a stopper mechanism, not shown. The gears 27 and 53 or the gears 30 and 57 are adapted to be selectively, in meshing engagement with each other.

With such a construction, when the arm supporting member 23 is fixed by the stopper mechanism, not shown, and the gears 30 and 57 are brought into meshing engagement with each other and the gears 27 and 53 are spaced apart from each other and the gear box is fixed by the stopper mechanism, not shown, and the drive source 51 is operated, the rotatable shaft 24 is rotated through the intermediary of the gears 55, 58, 57 and 30, whereby the sucker, not shown, is moved up and down. On the other hand, when the fixing of the gear box 59 by the stopper mechanism is released and the actuator is operated to rotate the rotatable shaft 60 clockwise by a predetermined angle, the gear box 59 is rotated to a position indicated by broken line, and the gear 57 becomes spaced apart from the gear 30 and the gears 27 and 53 come into meshing engagement with each other. When in this state, the fixing of the arm supporting member 23 is released and the drive source 51 is operated, the arm supporting member 23 is circumferentially rotated through the intermediary of the gears 55, 54, 53 and 27. Thus, in the third embodiment, the drive source 51 can be made single and therefore, costs can be reduced.

Figure 12:
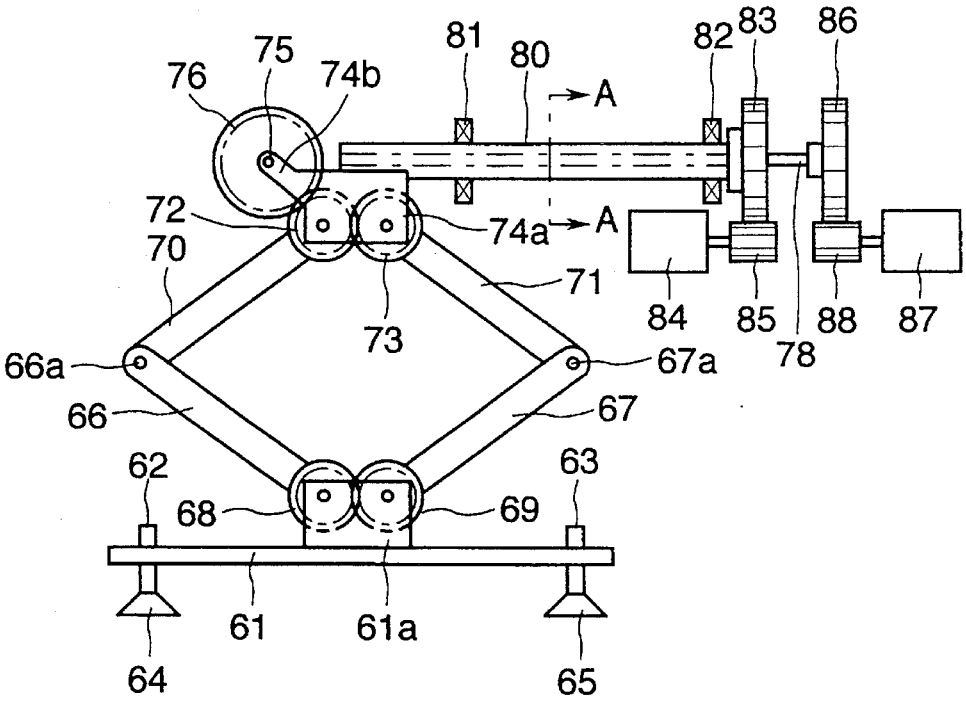
FIG. 12 is a front view of a fourth embodiment of the present invention.
Figure 13:
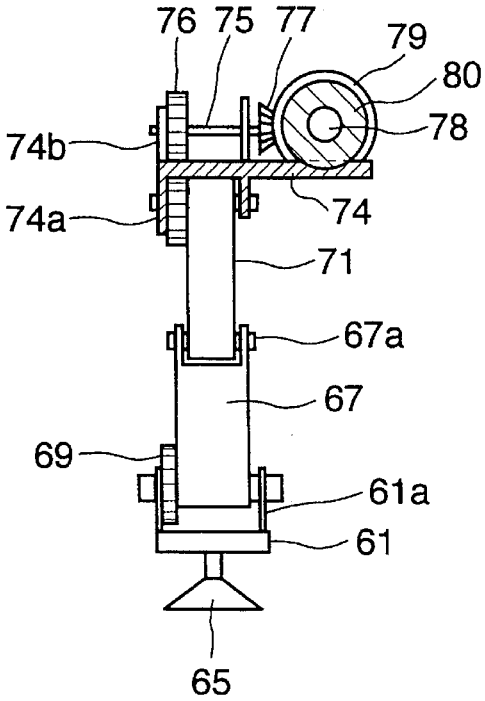
FIG. 13 is a cross-sectional view taken along the line A—A of FIG. 12.

FIG. 12 is a front view of a fourth embodiment of the present invention, and FIG. 13 is a cross-sectional view taken along the line A—A of FIG. 12. In this embodiment, the link mechanism differs in construction from that in the first to third embodiments. As in the first embodiment, suction units 64 and 65 are mounted on a sucker supporting member 61 through nipples 62 and 63, respectively. Gears 68 and 69 coupled to one end of arms 66 and 67 and meshing with each other are rotatably mounted on an arm mounting portion 61*a* formed integrally on the upper surface of the sucker supporting member 61. One end of arms 70 and 71 is connected to the other ends of the arms 66 and 67, respectively, through respective pins 66*a* and 67*a*. Gears 72 and 73 are fixed to the other ends of the arms 70 and 71, respectively, and these gears 72 and 73 while being in meshing engagement with each other are journalled to an arm mounting portion 74*a* formed integrally on the lower surface of an arm supporting member 74. The upper surface of the arm supporting member 74 and one end of a cylinder member 80 are combined.

The upper surface of the arm supporting member 74 is formed with a gear shaft mounting portion 74*b*, on which a gear shaft 75 is mounted. One gear 76 on this gear shaft 75 is in meshing engagement with the gear 72, and the other level gear 77 on the gear shaft 75 is in meshing engagement with one gear 79 on the rotatable shaft 78. The rotatable shaft 78 is through-supported in the cylinder member 80 which is rotatably supported by a frame, not shown, through bearings 81 and 82. A gear 83 is fixed to the right end of the cylinder member 80 and is in meshing engagement with the gear 85 of a first drive source 84. A gear 86 mounted on the other end of the rotatable shaft 78 is in meshing engagement with the gear 88 of a second drive source 87.

With such a construction, when the first drive source 84 is operated, the cylinder member 80 is rotated through the intermediary of the gears 85 and 83 and finally, the suckers 64 and 65 are rotated around the cylinder member 80. On the other hand, when the second drive source 87 is operated, the rotatable shaft 78 is rotated through the intermediary of the gears 88 and 86 and the arms 70 and 71 are pivotally moved through the intermediary of the gears 79, 77, 76, 72 and 73. When the arms 70 and 71 are pivotally moved, the arms 66 and 67 are pivotally moved through the intermediary of pins 66*a* and 67*a* and the gears 68 and 69 are rotated, whereby the suction unit supporting member 61 is moved up and down. In this fourth embodiment, the movement range of the sucker supporting member 61 can be made greater than in the first embodiment.

Figure 14:
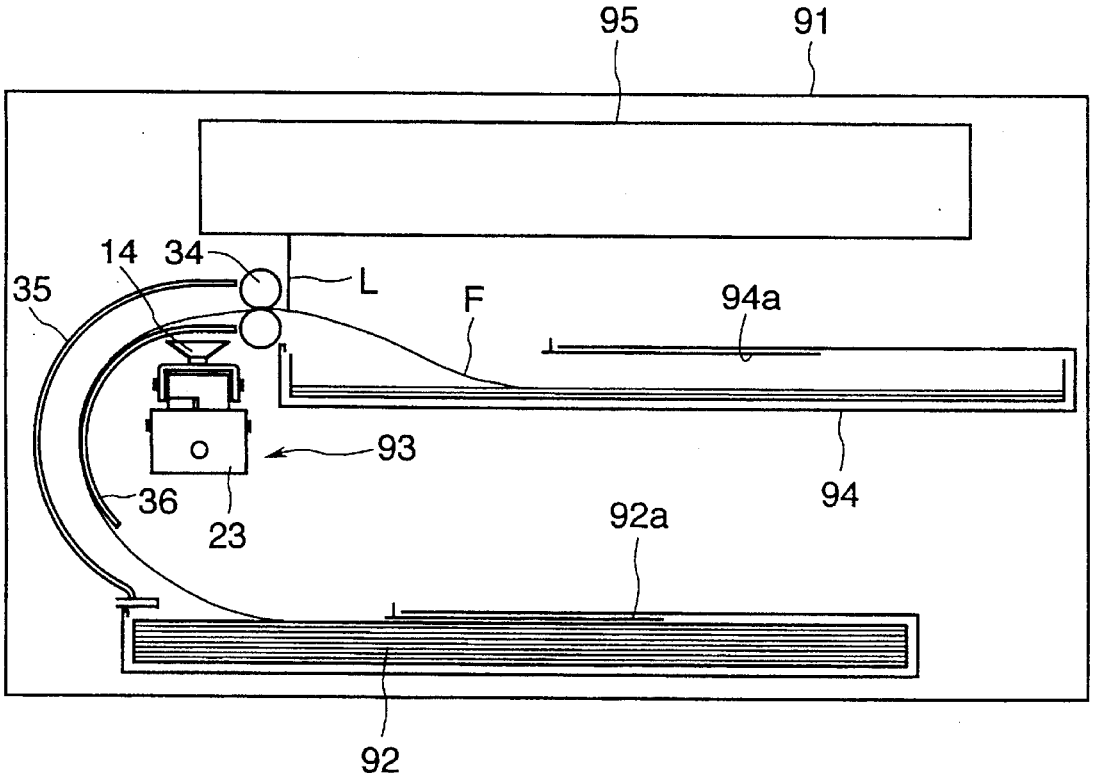
FIG. 14 shows the construction of a fifth embodiment of the present invention.

FIG. 14 shows the construction of a recording or reading apparatus according to a fifth embodiment of the present invention. A supply magazine 92 is disposed in the lower portion of the recording or reading apparatus 91, and a sheet supplying device 93 according to any of the first to fourth embodiments is disposed above it, and a receive magazine 94 is disposed at the right of it. Above the sheet supplying device 93 and the receive magazine 94, there is disposed an optical unit 95 provided with a laser source and a rotatable mirror and emitting a laser beam L. Covers 92*a* and 94*a* are openably-closably attached to the supply magazine 92 and the receive magazine 94, respectively, so that film sheets F contained in the respective magazines may be kept light-tight.

The film sheets F contained in the supply magazine 92 are conveyed one of one to a pair of rollers 34 by the sheet supplying device 93, and are discharged toward the receive magazine 94 by the pair of rollers 34. When the film sheet F is discharged from the pair of rollers 34, the laser beam L is applied from the optical unit 95 onto the film sheet F, whereby an image is recorded on the film sheet F or an image is read from the film sheet F. The laser beam L is scanned laterally as main scanning, and the pair of rollers 34 are scanned longitudinally as sub scanning.

In the present embodiment the conveying system can be simplified by using the sheet supplying device according to any of the first to fourth embodiments in the recording or reading apparatus 91, whereby the apparatus can be made compact and inexpensive. Also, other various embodiments can be conceived from the first to fifth embodiments on the basis of the purport of the present invention.

In the sheet supplying device according to each of the above-described embodiments, the suction units are moved diametrically by the diametrical moving mechanism and moreover are moved circumferentially by the circumferential moving mechanism and therefore, the structure of the device can be made simple and compact and thus, the number of parts can be decreased, and this leads to the ease of maintenance and reduced costs.

Also, the recording or reading apparatus according to each embodiment enables the sheet supplying device to be compact and be installed at any free location and thus, the whole of the apparatus can be made compact.

Embodiments shown in FIGS. 15 to 43 will hereinafter be described in detail.

Figure 15:
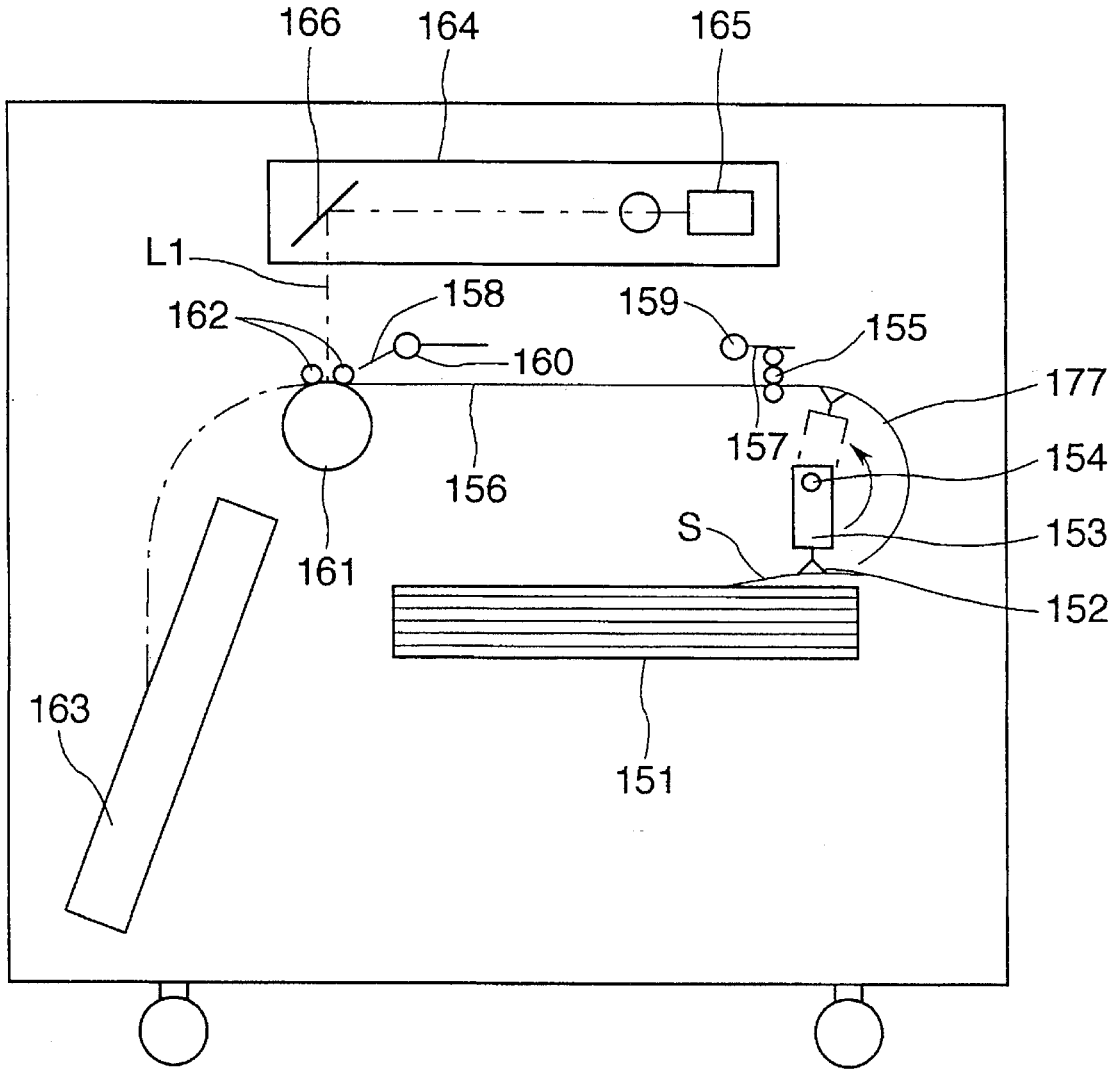
FIG. 15 shows the construction of a sixth embodiment of the present invention.

Referring to FIG. 15 which shows the construction of a sixth embodiment of the present invention, a supply magazine 151 having sheets S piled therein is substantially horizontally disposed at the center within the device, a sucker 152 connected to an airpump through an air hose is mounted on a sucker rotating block 153 above the right side of the supply magazine 151 and further, by the both sides of the sucker rotating block 153 being fixed to a shaft 154, the sucker 152 is rotatable about the shaft 154. Also, a pair of conveying rollers 155 are provided forwardly of an upper position to which the sucker 152 has been rotated, and a holding plate 156 is provided at the left of the pair of conveying rollers 155.

Further, above the right end and left end of the holding plate 156, a push lever 157 and a sheet registering portion 158 are provided for rotation about a shaft 159 and a shaft 160, respectively, and both of then are movable back and forth relative to the holding plate 156. At the left of the holding plate 156, a sub scanning drum 161 and two nip rollers 162 are provided closely adjacent to each other, and a receive magazine 163 is provided below the left side of the sub scanning drum 161. An optical unit 164 is provided above the holding plate 156 so that a beam of light emitted from a laser source 165 provided in the optical unit 164 may be reflected by a mirror 166 and thereafter be applied to between the two nip rollers 162 to thereby effect main scanning.

Figure 16:
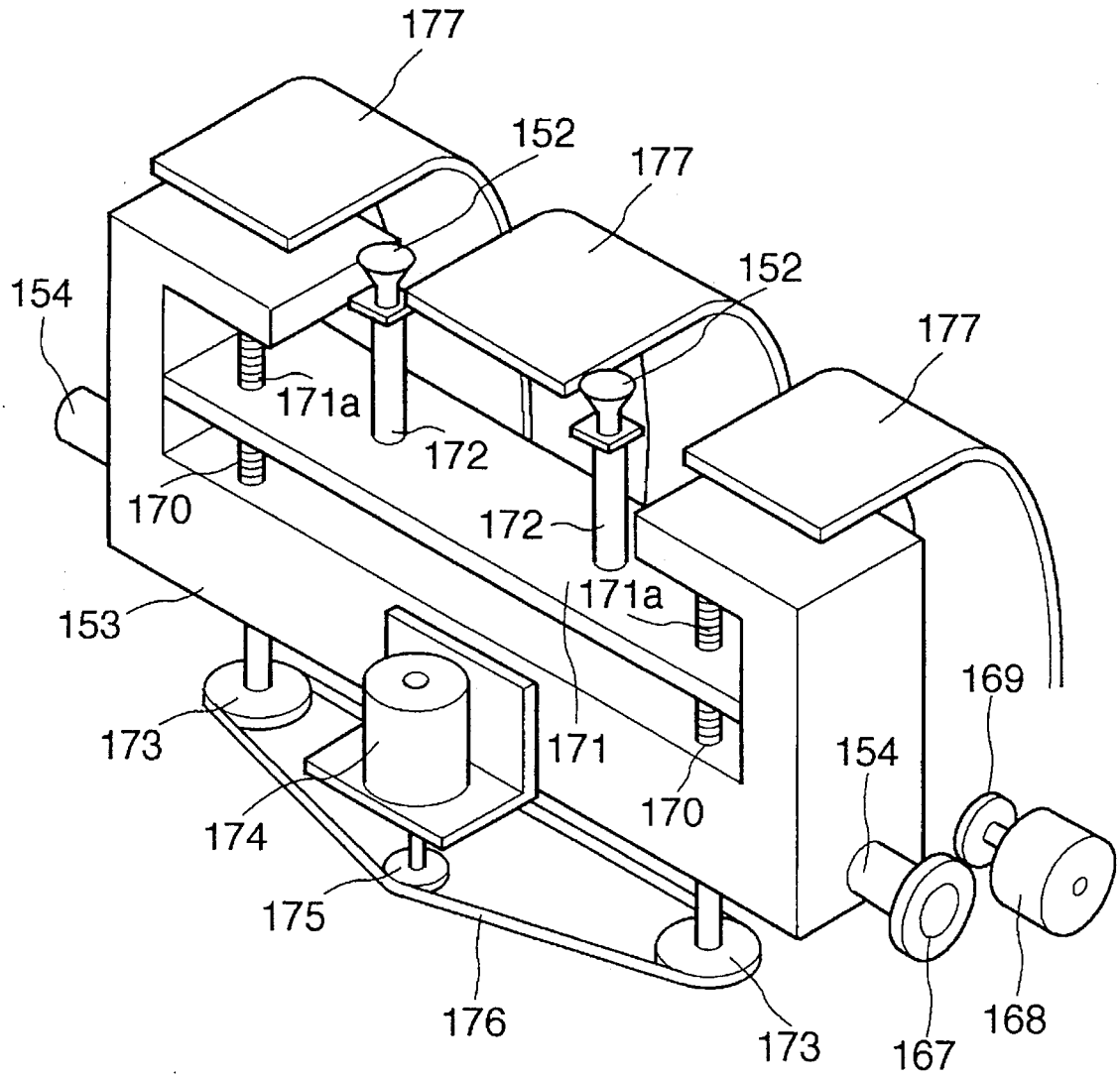
FIG. 16 is a perspective view of a sucker driving mechanism portion.

FIG. 16 is a perspective view of such a sucker driving mechanism portion, and in this figure, a gear 167 is connected to one end of the shaft 154. This gear 167 is in meshing engagement with a gear 169 to which a motor 168 is connected, and design is made such that by the motor 168 being driven, the gears 169 and 167 are successively rotated to thereby rotate the sucker rotating block 153. Ball screws 170 are provided in the sucker rotating block 153, and these ball screws 170 are threadably engaged with threaded holes 171*a* in a sucker mounting plate 171. Further, suction unit 152 are fixed to the suction mounting plate 171 with sucker holding members 172 interposed therebetween.

On the other hand, the ball screws 170 are connected to pulleys 173 below the suction unit rotating block 153 and are adapted to be rotated relative to each other by a pulley 175 connected to the lower portion of a motor 174 mounted on the suction unit rotating block 153, through a timing belt 176. Further, a two-division or three-division guide plate 177 is arcuately provided over the outer peripheral portion of the sucker rotating block 153 so as not to hamper the rotation and movement of the suckers 152.

Figure 17:
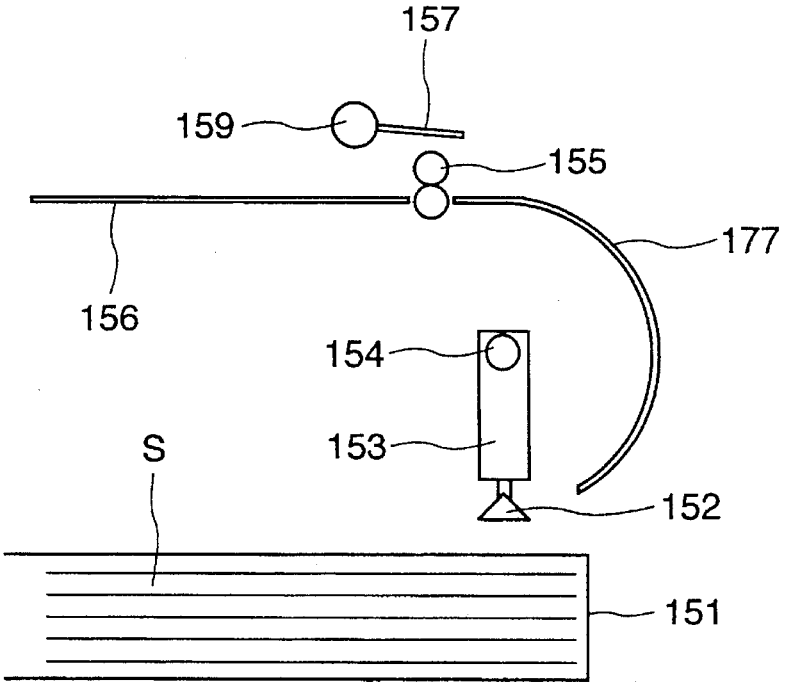
FIG. 17 is an illustration of the sucker driving mechanism.
Figure 18:
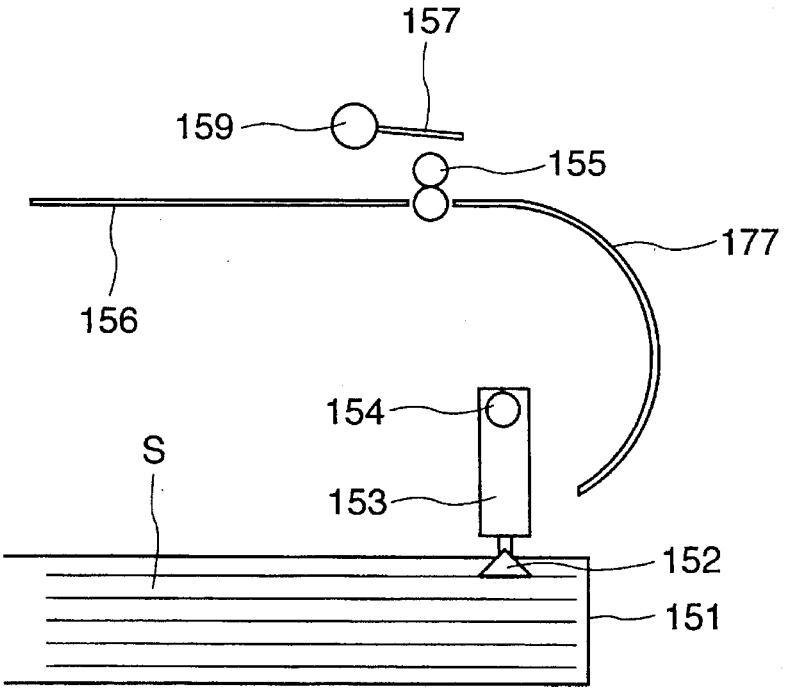
FIG. 18 is an illustration of the sucker driving mechanism.
Figure 19:
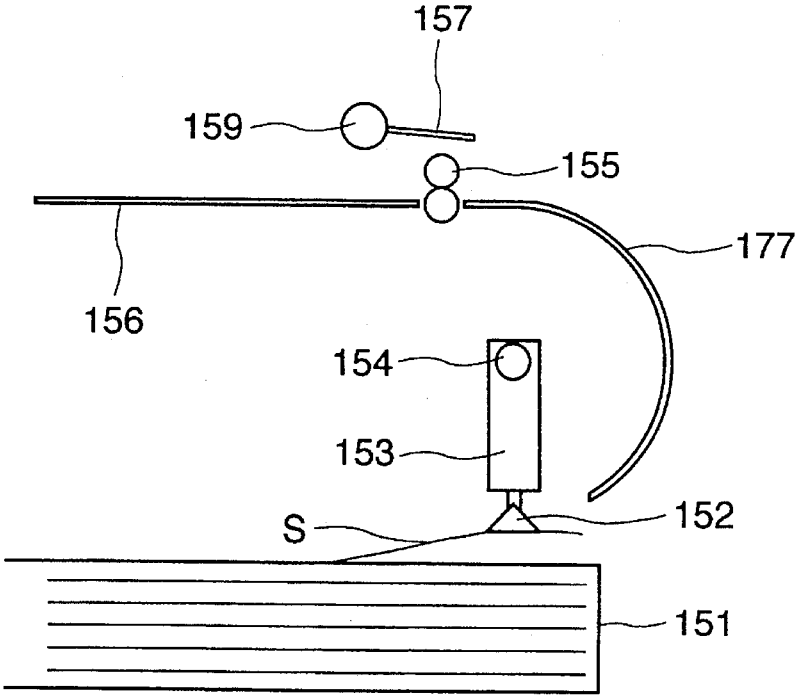
FIG. 19 is an illustration of the sucker driving mechanism.

The conveyance procedure of the sheets S will now be described in detail with reference to FIGS. 17 to 22. In a state as shown in FIG. 17 wherein the suction unit rotating block 153 is in the lowest position which is its base position and the suction unit 152 has been inwardly moved to its base position so as not to interfere with the supply magazine 151, the supply magazine 151 is first inserted into the body device. Then, as shown in FIG. 18, the ball screw 170 is rotated with the rotation of the motor 174 and the suction unit mounting plate 171 is lowered. Thereby the suction unit 152 is also lowered and at the same time, it sucks the uppermost one of the piled sheets S by the sucking operation of the air pump. After the sucking operation, the motor 174 rotates reversely and the suction unit 152 is elevated and returned to its base position as shown in FIG. 19 while sucking the uppermost sheet S.

Figure 20:
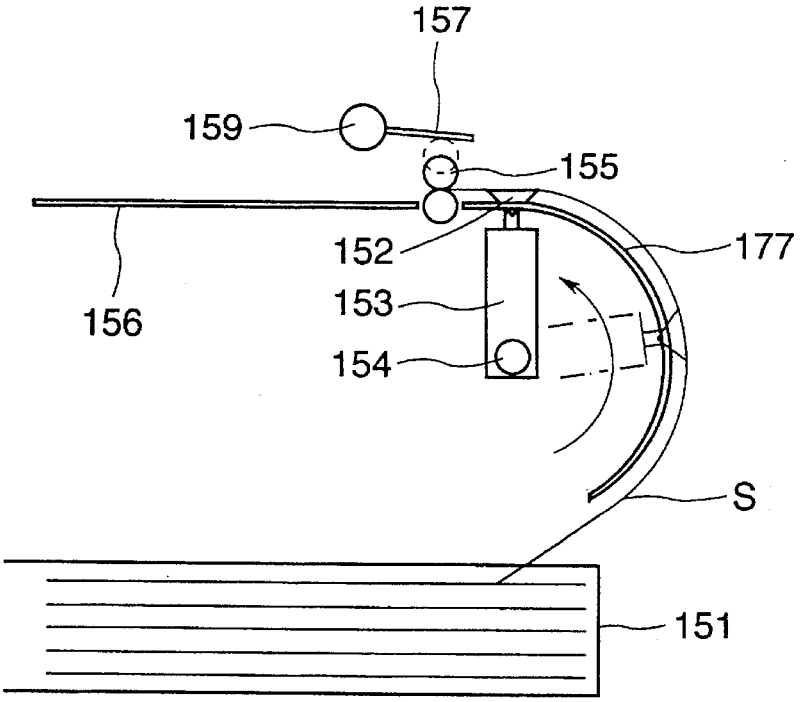
FIG. 20 is an illustration of the sucker driving mechanism.

Then, as shown in FIG. 20, the rotation of the motor 168 causes the suction unit rotating block 153 to be rotated counter-clockwise inside the guide plate 177, and the sucker rotating block turns its direction of movement by 180° while causing the sucked sheet S to bear against the outer side of the guide plate 177 and inserts the leading end of the sheet S into the nip between the pair of conveying rollers 155, whereafter it is stopped. At this time, as indicated by broken line, one or both of the pair of conveying rollers 155 can be spaced from each other to thereby make the insertion of the leading end of the sheet S more reliable.

Figure 21:
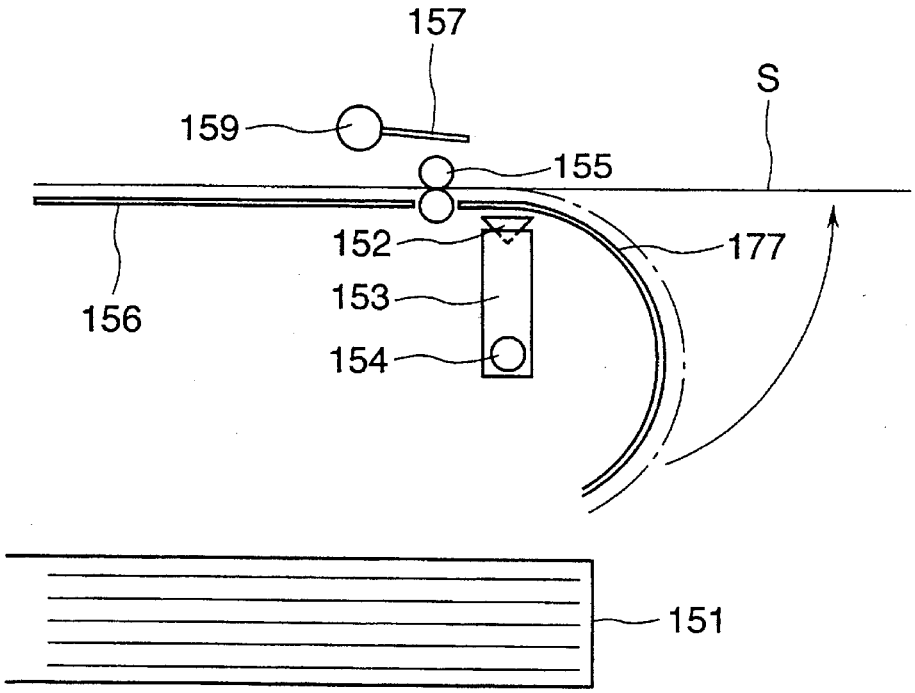
FIG. 21 is an illustration of the sucker driving mechanism.
Figure 22:
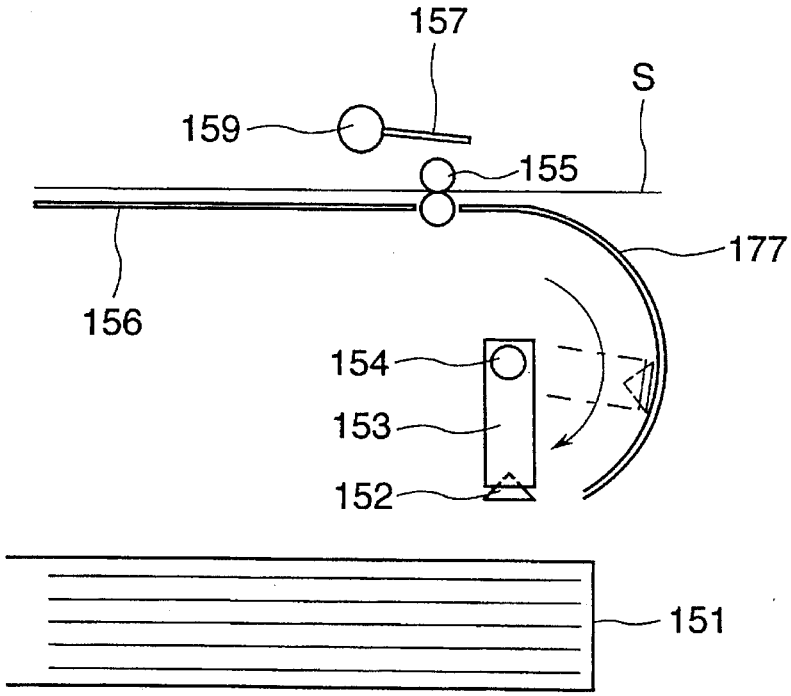
FIG. 22 is an illustration of the sucker driving mechanism.

When the sheet S is inserted into the nip between the pair of conveying rollers 155, the suction of the air pump is stopped as shown in FIG. 21 and the motor 174 rotates reversely, whereby the suction unit 152 is moved to the inside of the guide plate 177 and retracts from the conveyance path of the sheet S, and is stopped. Lastly, the pair of conveying rollers 155 convey this sheet S onto the holding plate 156 and at the same time, as shown in FIG. 22, the motor 168 rotates reversely and the suction unit rotating block 153 is rotated clockwise and is stopped in its base position, and the sucker 152 is likewise lowered to its base position and assumes its standby. An image is recorded on the sheet S conveyed onto the holding plate 156, as in the prior art, whereafter the sheet S is received into the receive magazine 113.

In this manner, the width of the device can be reduced to thereby make the delivery of the sheet S from the supply magazine 151 to the pair of conveying rollers 155 more reliable. The driving mechanism for moving or rotating the sucking means is not restricted to the system of the present embodiment, but other method or methods are also possible.

Figure 23:
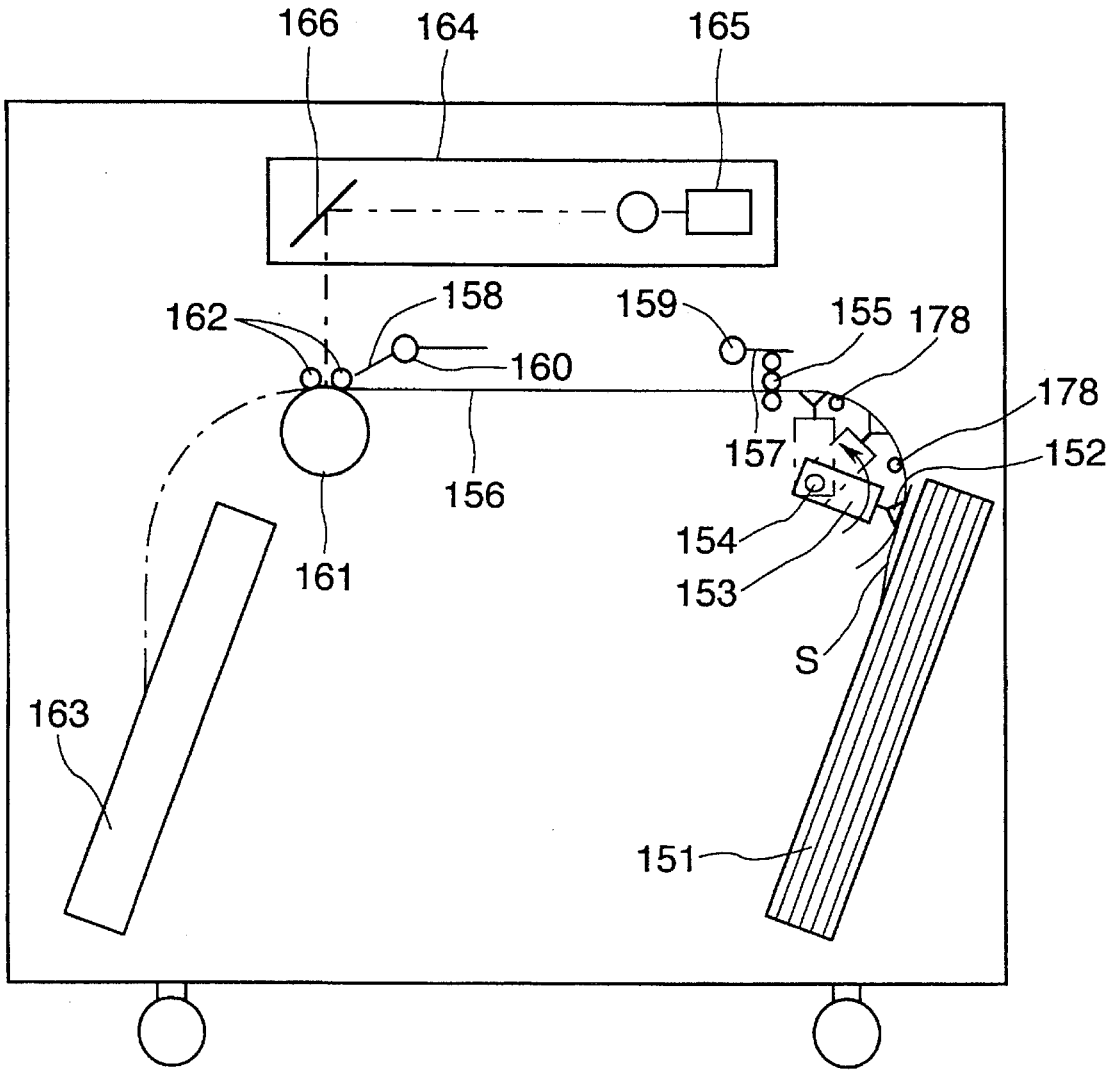
FIG. 23 shows the construction of a modification of the sixth embodiment.

FIG. 23 shows the construction of a modification of the sixth embodiment. A supply magazine 151 is disposed below a holding plate 156 at an angle substantially parallel to a receive magazine 163, and the turning of the direction of the sheet S is effected by about 110°. Also, a plurality of guide rollers 178 are used in lieu of the guide plate 177 and are divisionally disposed at locations whereat they do not collide with the path of rotation of the suction unit 152, as in the sixth embodiment.

As described above, the angle of turning of the direction of the sheet S is not limited to 180°, but any angle equal to or greater than 90° would result in a similar effect, and the means for causing the sheet S to bear against the path of conveyance is not restricted to a plate-like member, but a rotatable member such as a roller would also lead to the obtainment of an effect similar to that of the sixth embodiment. Further, in the present embodiment, the supply magazine 151 is inclined and therefore, if the sub scanning drum 161 and the lower end portion of the supply magazine 151 are maintained parallel to each other, the inclination registering member and its procedure could be eliminated.

Figure 24:
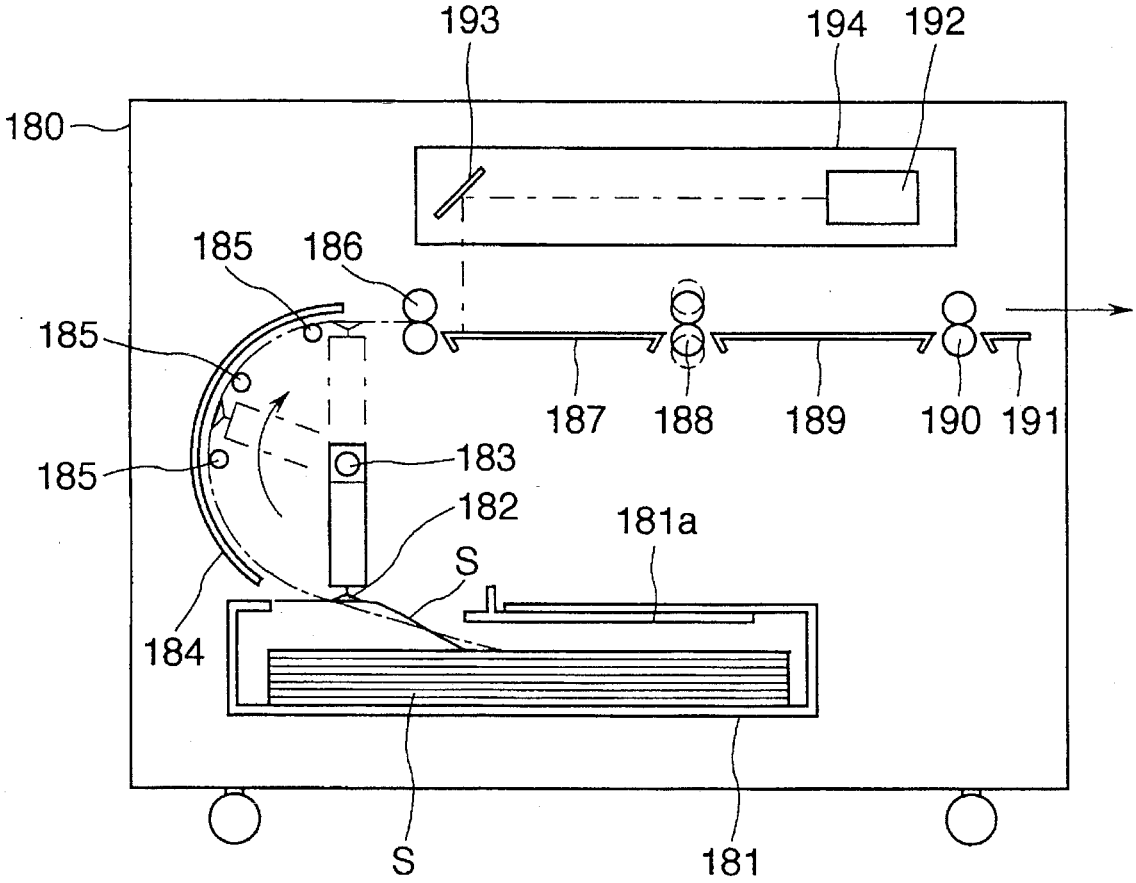
FIG. 24 shows the construction of a seventh embodiment of the present invention.

Referring to FIG. 24 which shows the construction of a seventh embodiment of the present invention, a supply magazine 181 disposed substantially horizontally in a recording apparatus body 180 is provided with a sliding lid 181*a* openable and closable by a mechanism, not shown, and has sheets S piled therein. Above the left side of this supply magazine 181, a sucker 182 provided with a suction unit driving mechanism portion similar to that in the sixth embodiment is provided for rotation about a shaft 183. Also, on the outside along the rotation orbit of the suction unit 182, a guide plate 184 and a plurality of guide rollers 185 are provided arcuately over approximately 180°.

Further, forwardly of the guide plate 184, there are successively arranged a pair of sub scanning rollers 186, a guide plate 187, a pair of conveying rollers 188, a guide plate 189, a pair of conveying rollers 190 and a guide plate 191, and above the guide plate 187, there is provided an optical system unit 194 containing therein a laser source 192 and polygon mirror for effecting scanning and a mirror 193 so that a beam of light emitted from a laser source 192 may be reflected by the mirror 193 and may effect main scanning at the left end of the guide plate 187.

With the sliding lid 181*a* closed, the supply magazine 181 is first inserted into the recording apparatus body 180, and after light interception in the recording apparatus body 180 is secured, the sliding lid 181*a* is opened. Subsequently, as in the sixth embodiment, the suction unit 182 is lowered and sucks the uppermost one of the sheets S by an air pump, and is again elevated, whereafter it is rotated to convey the sucked sheet S.

Further, the leading end of the sheet S is inserted into the nip between the sub scanning rollers 186 and at the same time, the suction force of the suction unit 182 is released, and the sucker 182 is lowered and moved to its base position. When the sheet S is inserted into the nip between the sub scanning rollers 186, it is conveyed to right at a constant speed and sub scanning is effected, whereby there is formed the latent image of a predetermined recorded image. Since at this time, the sheet S is conveyed while being held between the guide plate 184 and the guide rollers 185, the trailing end thereof moves more smoothly and thus, the deterioration of the image is prevented.

At this time, the pair of conveying rollers 188 are retracted from the conveyance path, and come into the conveyance path immediately before the trailing end of the sheet S leaves the sub scanning rollers 186. Further, the pair of conveying rollers 188 are rotated at the same peripheral speed as the sub scanning rollers 186 and further coveys the sheet S to right, and the sheet S is conveyed to an automatic developing device provided adjacent to the recording apparatus body 180 via the pair of conveying rollers 190 and the guide plate 191.

Thus, the sheet S may be of various sizes if it is longer than any of the guide plates 187, 189 and 191.

Figure 25:
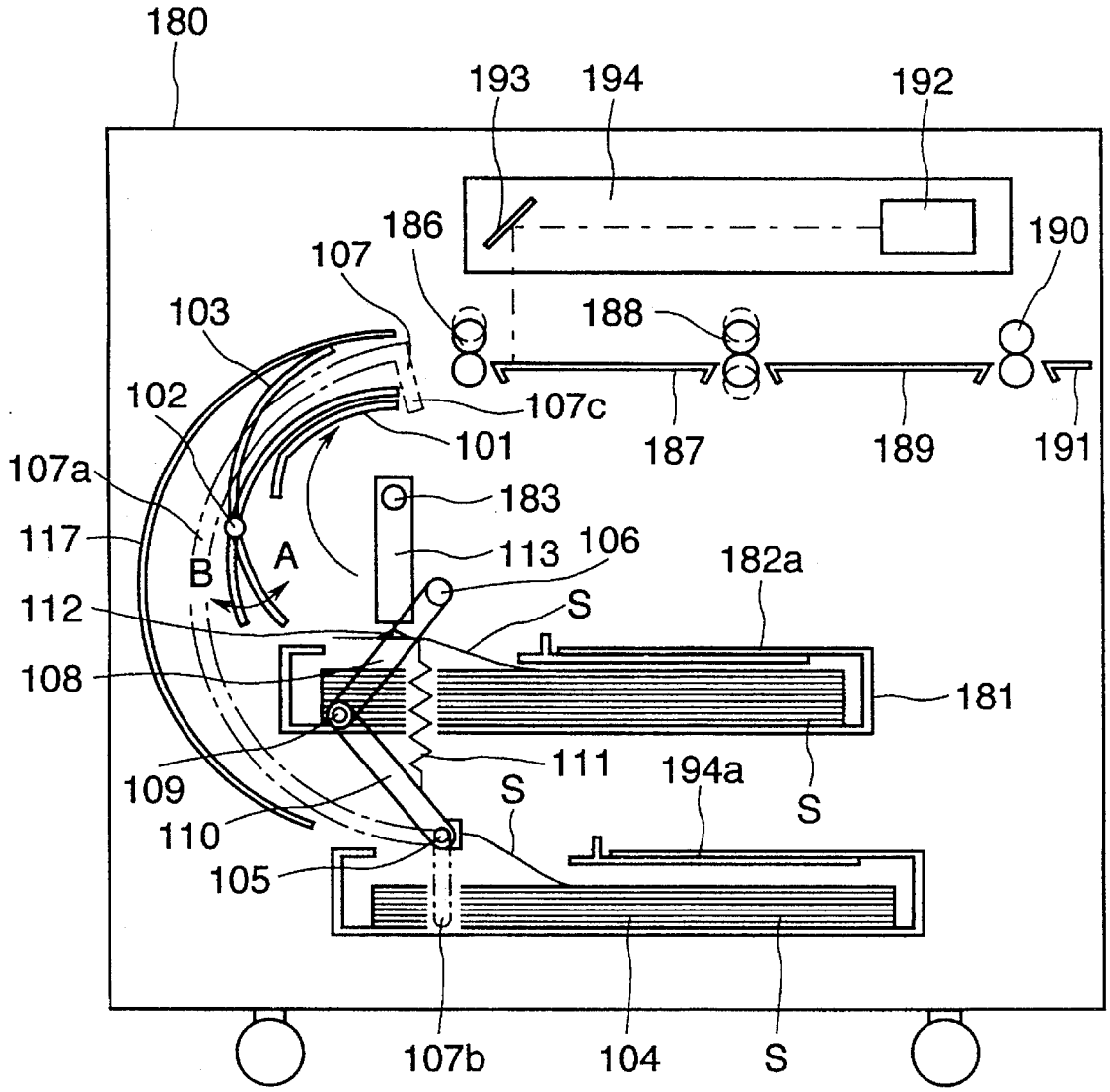
FIG. 25 shows the construction of an eighth embodiment of the present invention.

Referring to FIG. 25 which shows the construction of an eighth embodiment of the present invention, the same reference characters as those in FIG. 24 designate the same members. A guide plate 101 is provided inside and along the rotation path of the suction unit, and in lieu of the guide plate 184, there is provided a guide plate 103 rotatively movable by a predetermined angle about a shaft 102. A supply magazine 104 provided with a sliding lid 194*a* is provided below a supply magazine 181, and above the left side of the supply magazine 104, a guide shaft 105 is provided for rotative movement about a shaft 106 and along a guide hole 107 formed in two side plates, not shown. The guide hole 107 is of a shape comprising an arcuate portion 107*a* extending over 180°, and straight portions 107*b* and 107*c* formed on the opposite end portions thereof.

Figure 26:
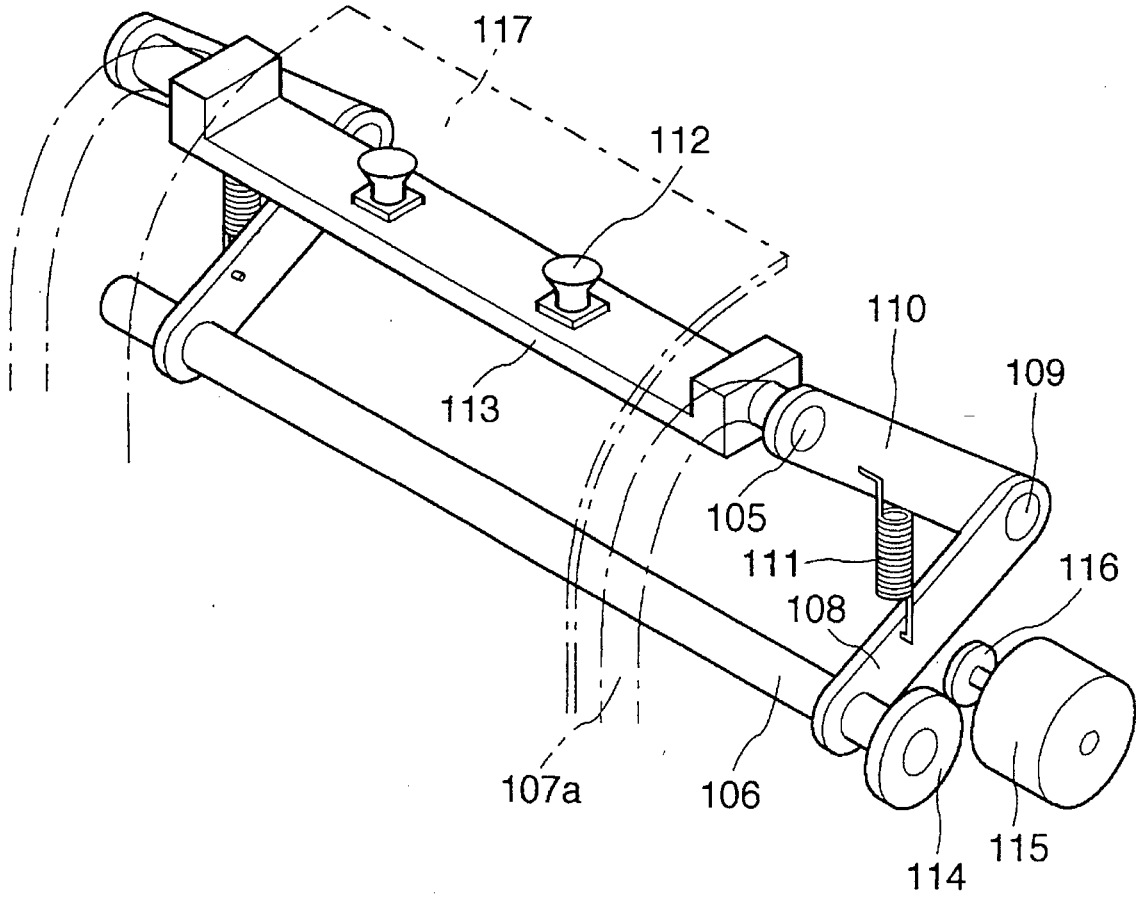
FIG. 26 is a perspective view of a sucker driving mechanism portion.

FIG. 26 is a detailed perspective view of a driving mechanism portion for the guide shaft 105. One end of an arm 108 is fixed to the shaft 106, and one end of an arm 110 is connected to the other end of the arm 108 for rotation about a shaft 109. A spring 111 is interposed between the arm 108 and the arm 110 so as to pull the arms 108 and 110 toward each other. Further, the guide shaft 105 is fixed to the other end of the arm 110, and the guide shaft 105 is fitted in the guide hole 107 and a sucker mounting plate 113 is mounted for rocking by a predetermined angle, and a suction unit 112 is directly fixed to the sucker mounting plate 113. A gear 114 is connected to one end of the shaft 106 and is in meshing engagement with a gear 116 connected to a motor 115. A guide plate 117 is provided outside the guide hole 107.

When the sheets S in the upper supply magazine 181 are to be used, the guide plate 103 is first rotatively moved to a position A, whereafter as in the seventh embodiment, the suction unit 112 is lowered and sucks the uppermost one of the sheets S, and is then elevated, and thereafter is rotated to convey the sucked sheet to the sub scanning rollers 186.

When the sheets S in the lower supply magazine 104 are to be used, the guide plate 103 is moved to a position B and retracts from the guide hole 107 which is the conveyance path.

Figure 27:
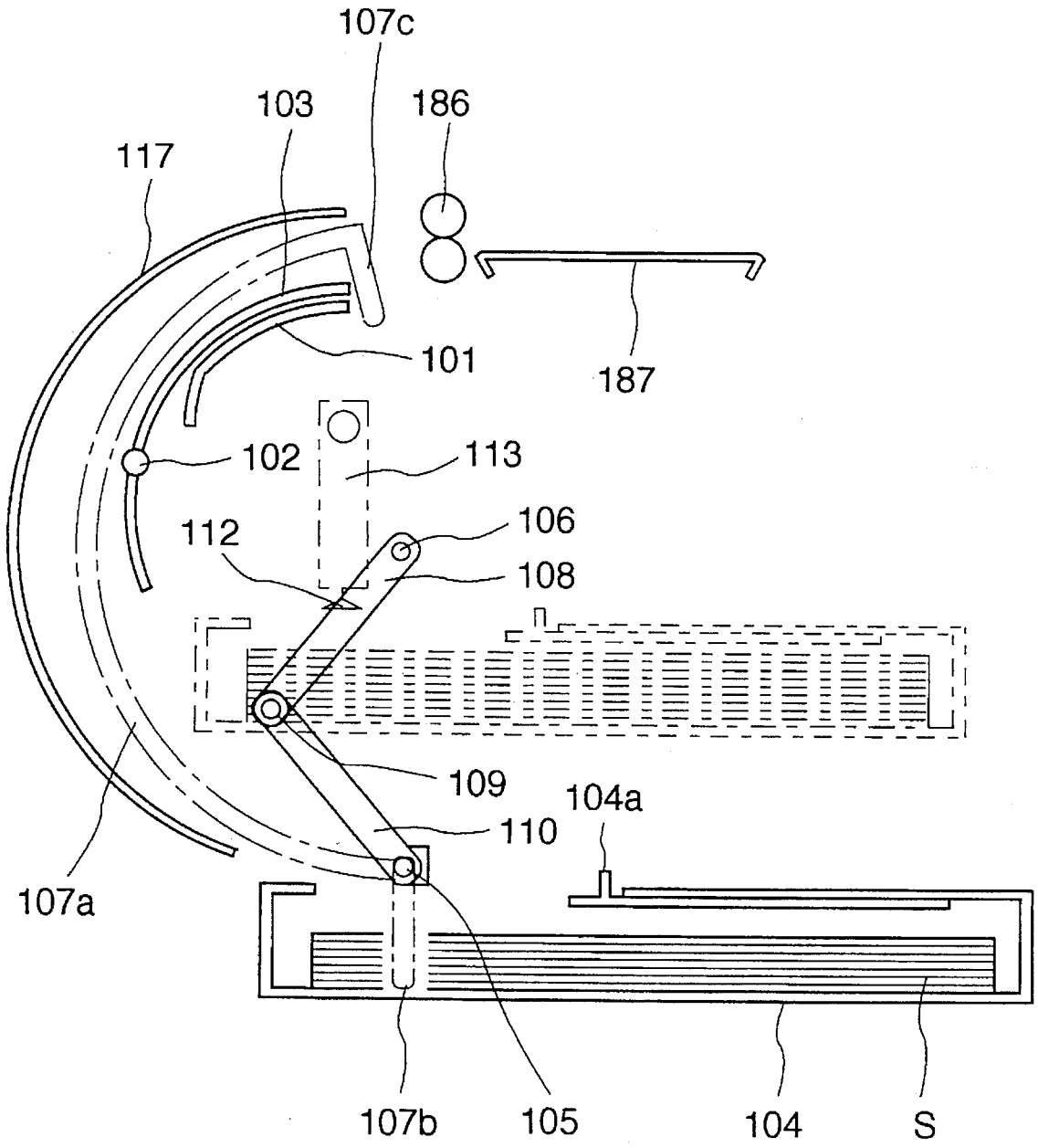
FIG. 27 is an illustration of the sucker driving mechanism.

Describing the sucker driving mechanism in this case with reference to FIGS. 27 to 34, the guide shaft 105 which is substantially in the same position as the sucker 112 is first moved to the point of intersection between the arcuate portion 107*a* and the straight portion 107*b* which is the base position as shown in FIG. 27, and when in this state, the motor 115 rotates, the arm 108 is rotated counter-clockwise through the intermediary of the gears 116 and 114, and the guide shaft 105 is restrained along the guide hole 107 and therefore, the spring 111 stretches to thereby widen the angle formed by the arms 108 and 110, and the guide shaft 105 is lowered in the straight portion 107*b*.

Figure 28:
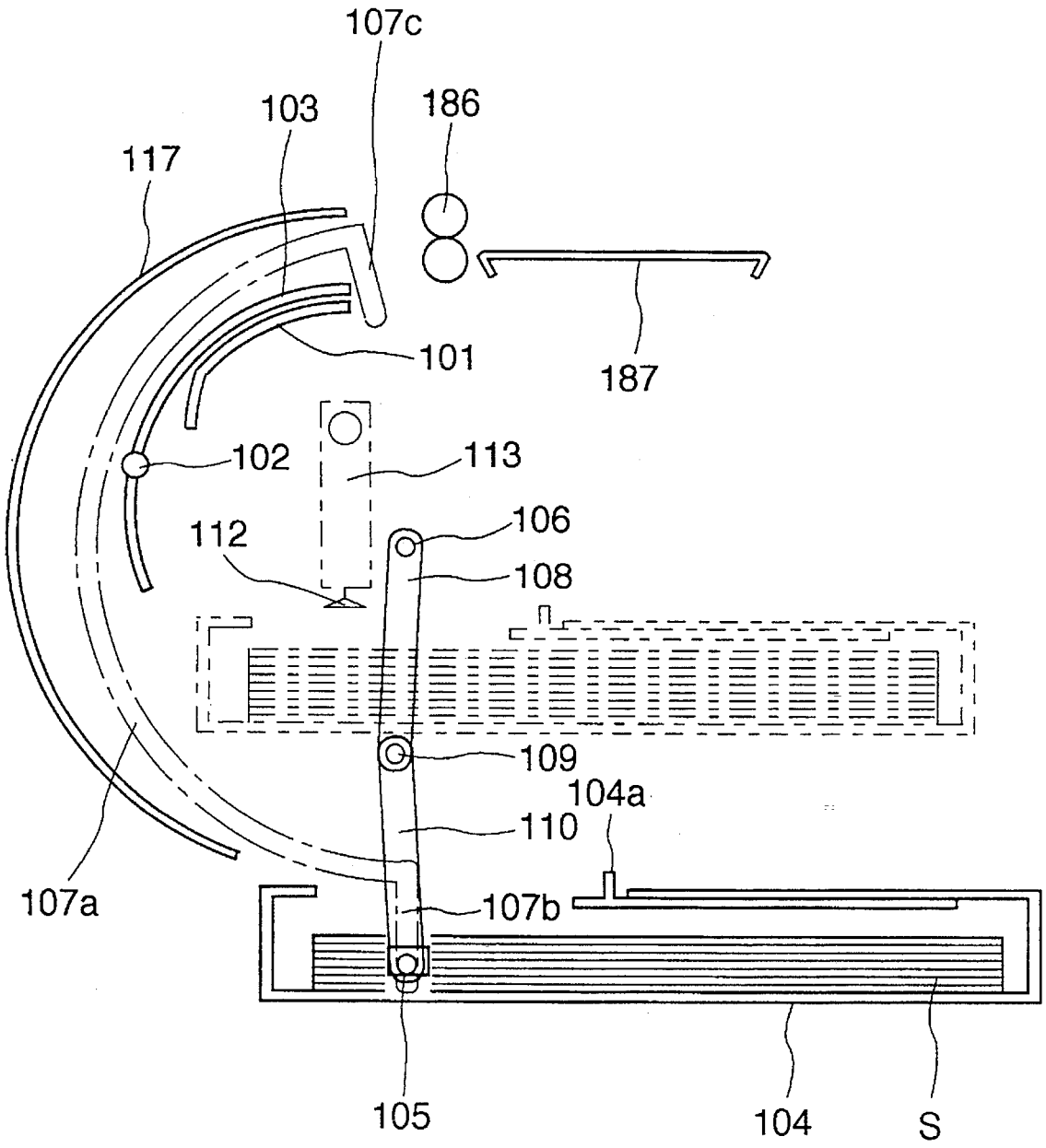
FIG. 28 is an illustration of the sucker driving mechanism.
Figure 29:
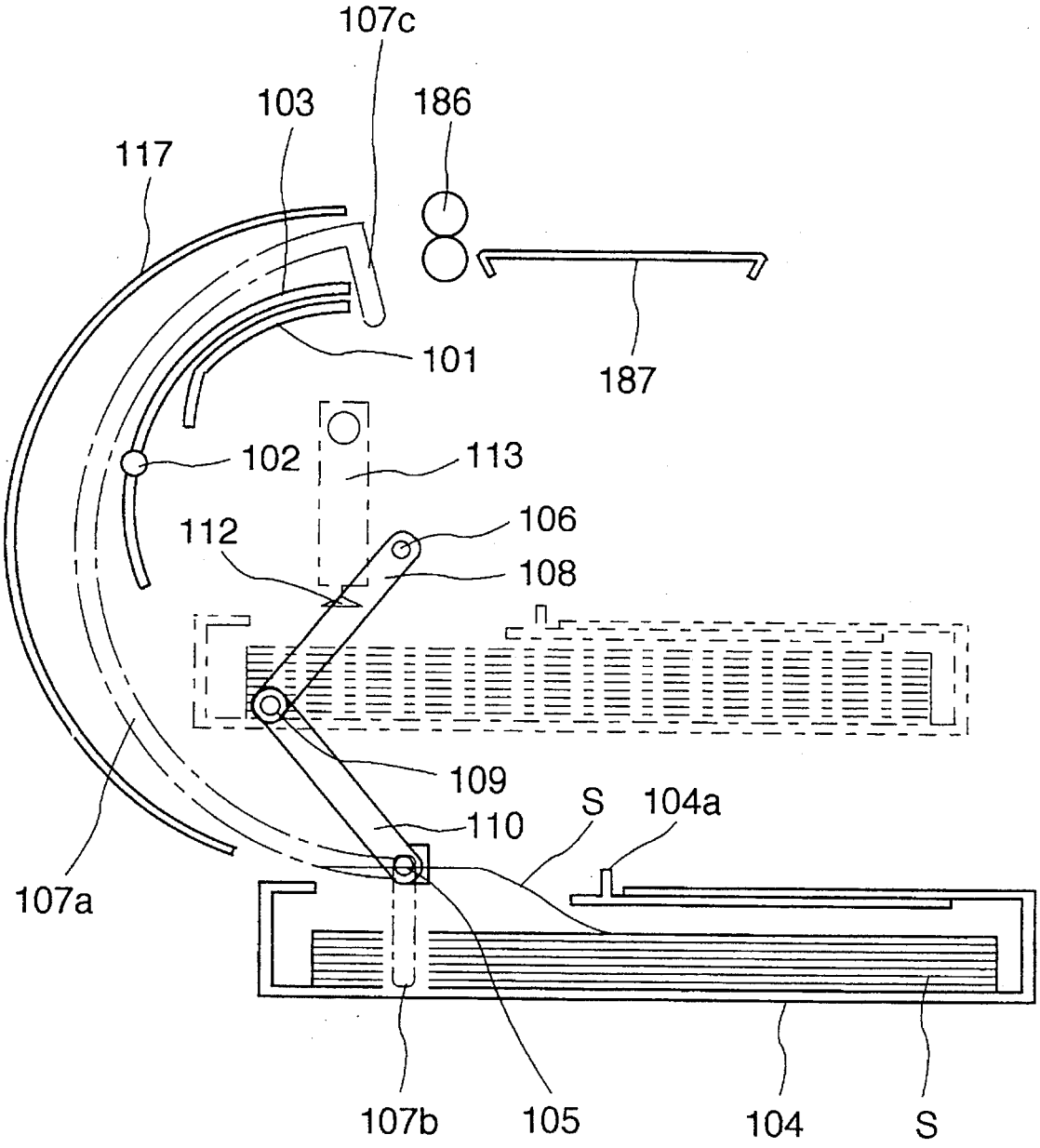
FIG. 29 is an illustration of the sucker driving mechanism.

Along therewith, the suction unit 112 is also lowered with the guide shaft 105 as shown in FIG. 28, and sucks the uppermost one of the sheets S by an air pump, not shown. At this time, the suction unit mounting plate 113 rocks so as to face downward from gravity and the sucker 112 horizontally and uniformly contacts with the sheet S and therefore, stable sucking is done. When the sheet S is sucked, the motor 115 rotates reversely to move the suction unit 112 again to its base position as shown in FIG. 29.

Figure 30:
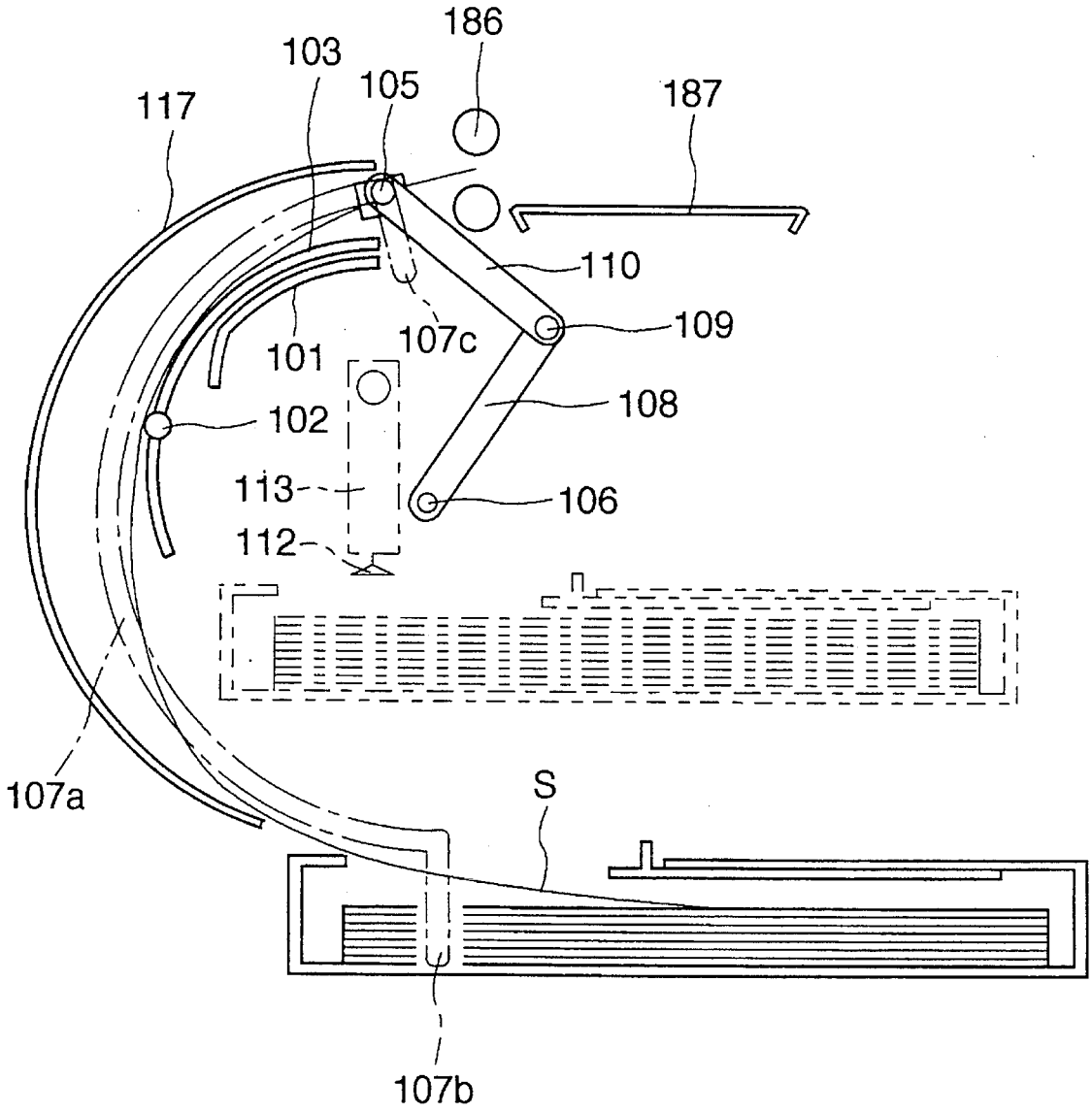
FIG. 30 is an illustration of the sucker driving mechanism.

When the motor 115 continues to rotate reversely, the guide shaft 105 is guided along the arcuate portion 107*a* of the guide hole 107 as shown in FIG. 30, and is rotated by about 180° clockwise about the shaft 106, whereby the sheet S is conveyed between the guide plate 103 and the guide plate 117 and the direction of movement thereof is turned. At this time, the suction unit mounting plate 113 is inhibited from rocking by any angle greater than a predetermined angle and therefore is always directed in a direction substantially opposite to the shaft 106. Also, at the same time, the upper one of the sub scanning rollers 186 is elevated to prepare for conveying the sheet S onto the guide plate 187.

Figure 31:
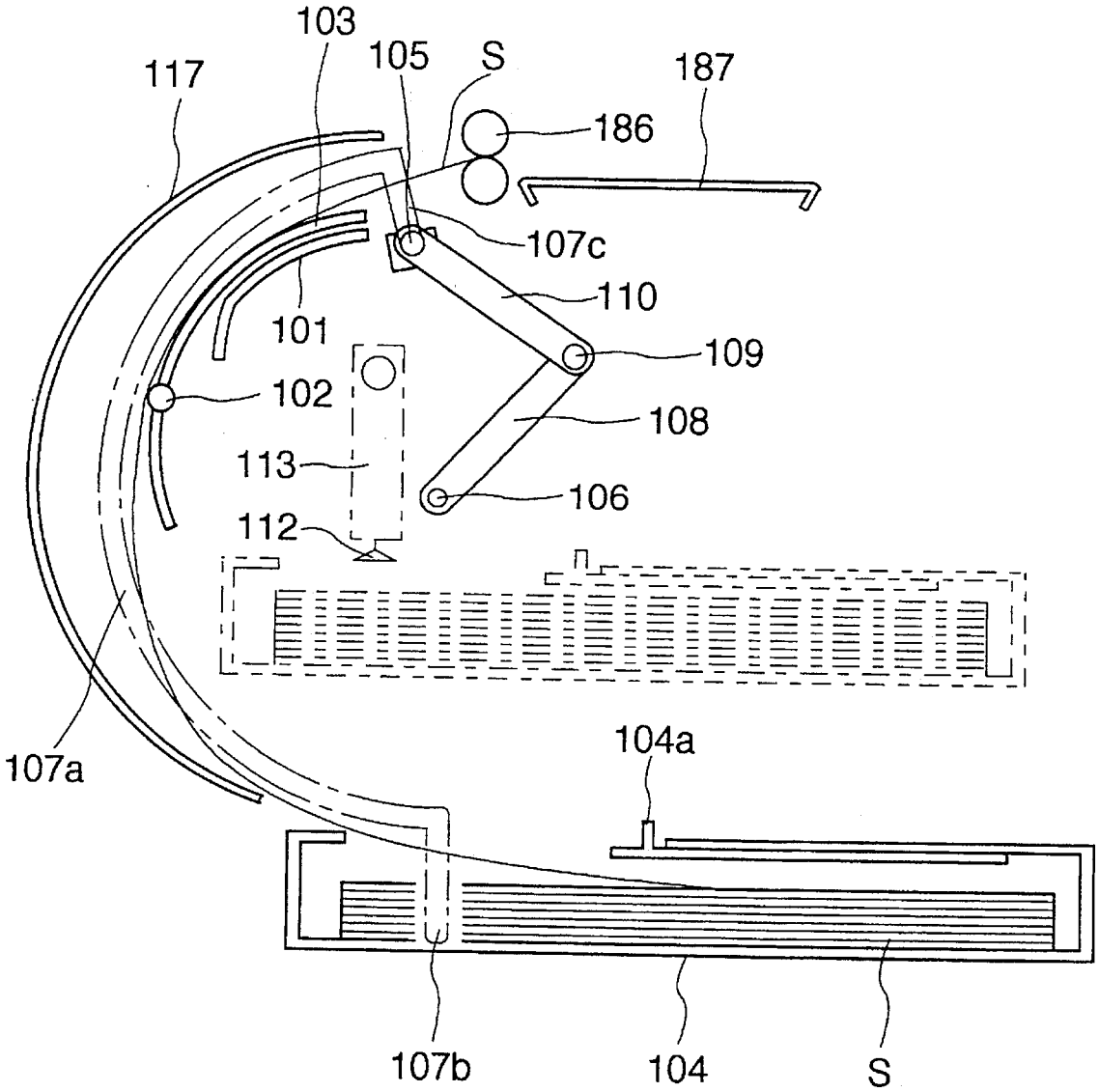
FIG. 31 is an illustration of the sucker driving mechanism.
Figure 32:
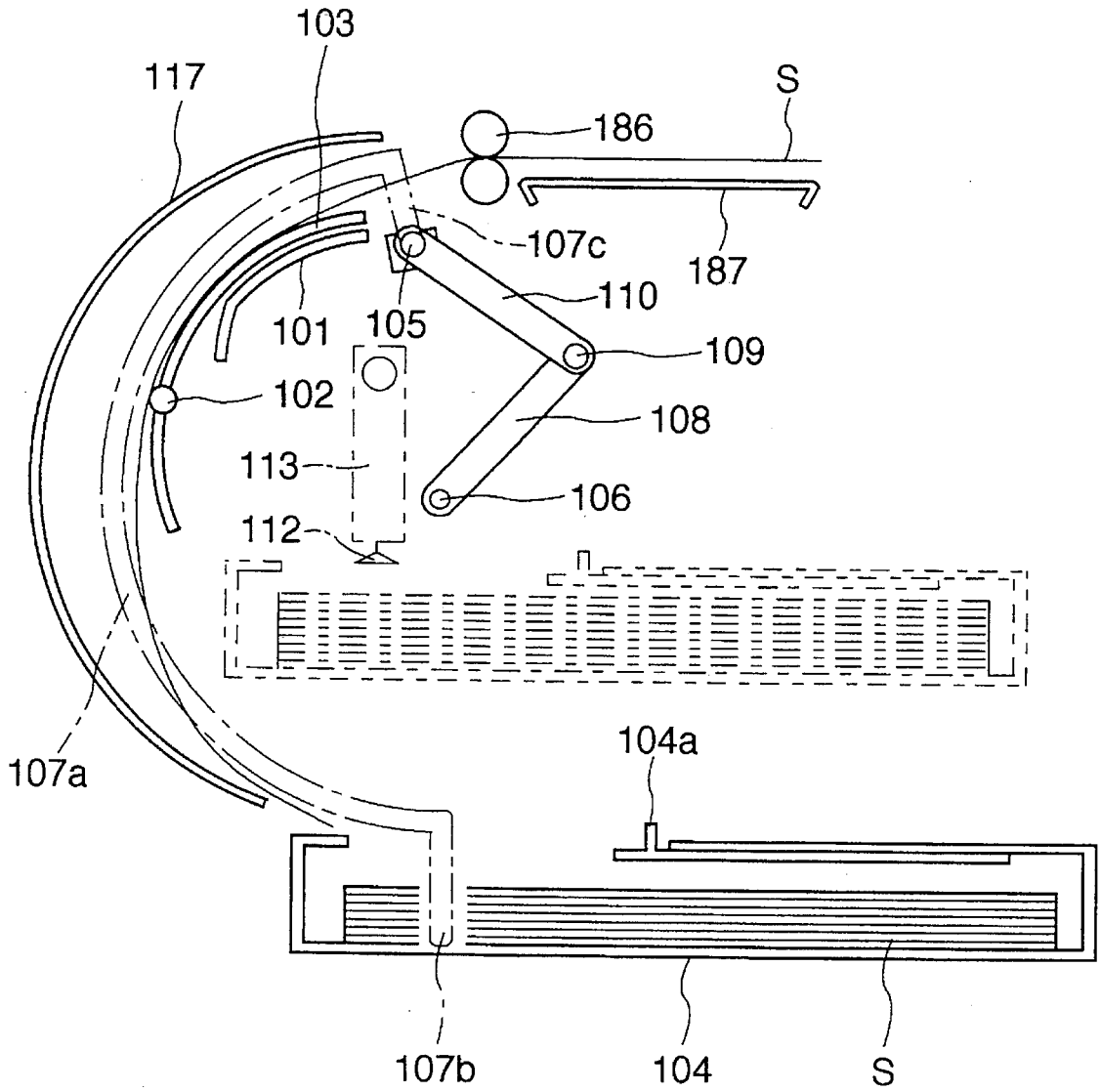
FIG. 32 is an illustration of the sucker driving mechanism.
Figure 33:
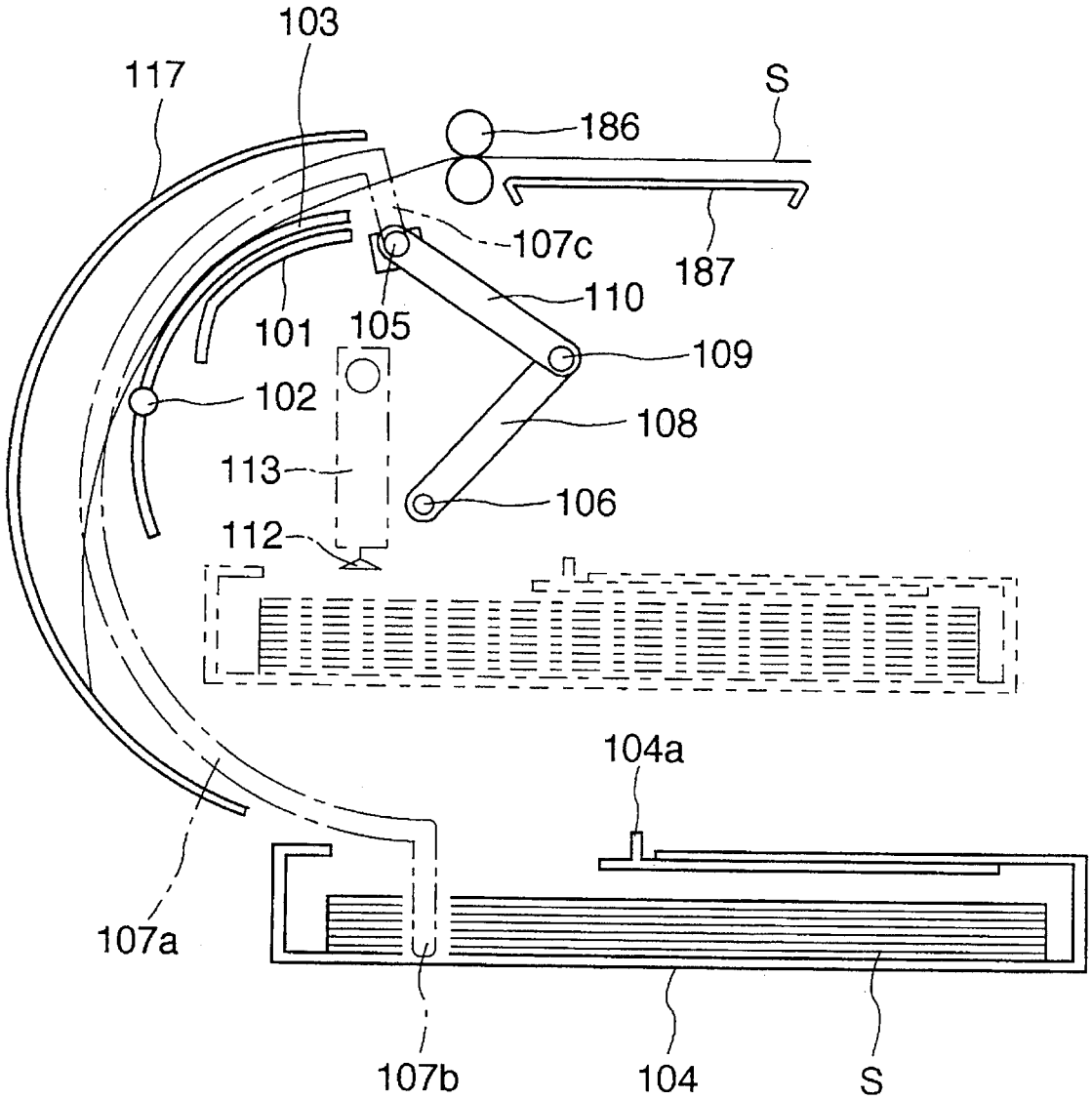
FIG. 33 is an illustration of the sucker driving mechanism.
Figure 34:
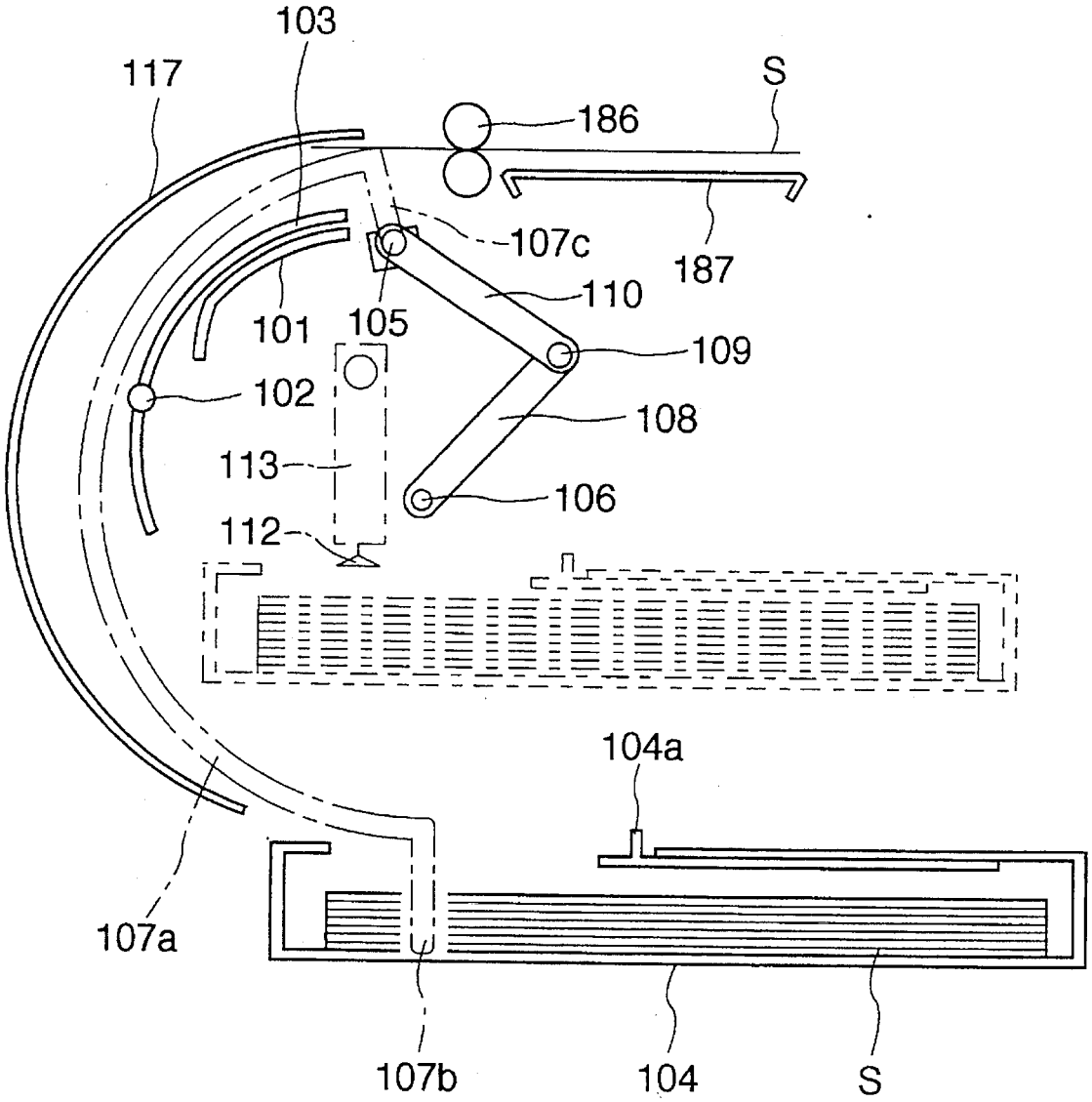
FIG. 34 is an illustration of the sucker driving mechanism.

Subsequently, as shown in FIG. 31, the upper one of the sub scanning rollers 186 is lowered to hold the leading end of the sheet S and at the same time, the suction of the air pump is stopped. Further, when the motor 115 continues to rotate reversely for a predetermined time, the spring 111 contracts with the pivotal movement of the arm 108 and the angle formed by the arms 108 and 100 becomes small, and the suction unit mounting plate 113 is lowered along the straight portion 107*c* and retracts from the conveyance path of the sheet S.

When the retraction of the sucker 112 is completed, the sub scanning rollers 186 are rotated and sub scans the sheet S and at the same time, the main scanning by the optical system unit 194 is effected, whereby a latent image is recorded on the sheet S. At this time, the trailing end of the sheet S moves smoothly while being in contact with the guide plate 117, in accordance with the procedure shown in FIGS. 32, 33 and 34 and therefore, the load during constant speed conveyance applied to the sheet S and the fluctuation thereof become small and thus, the recorded image can be made more stable without being deteriorated.

Figure 35:
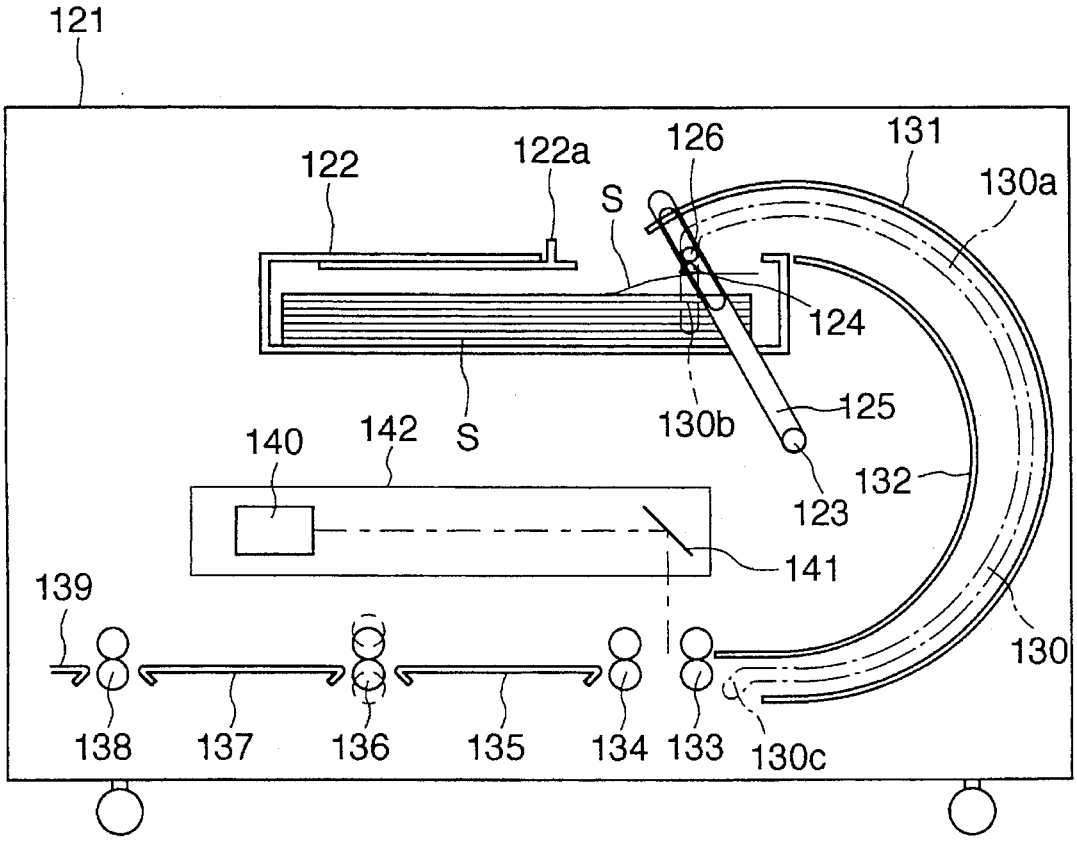
FIG. 35 shows the construction of a ninth embodiment of the present invention.

Referring to FIG. 35 which shows the construction of a ninth embodiment of the present invention, a supply magazine 122 provided with a sliding lid 122*a* is provided in the upper portion of a recording apparatus body 121, and sheets S are piled in the supply magazine 122. A sucker 124 supported by a shaft 123 is provided above the right side of the supply magazine 122.

Figure 36:
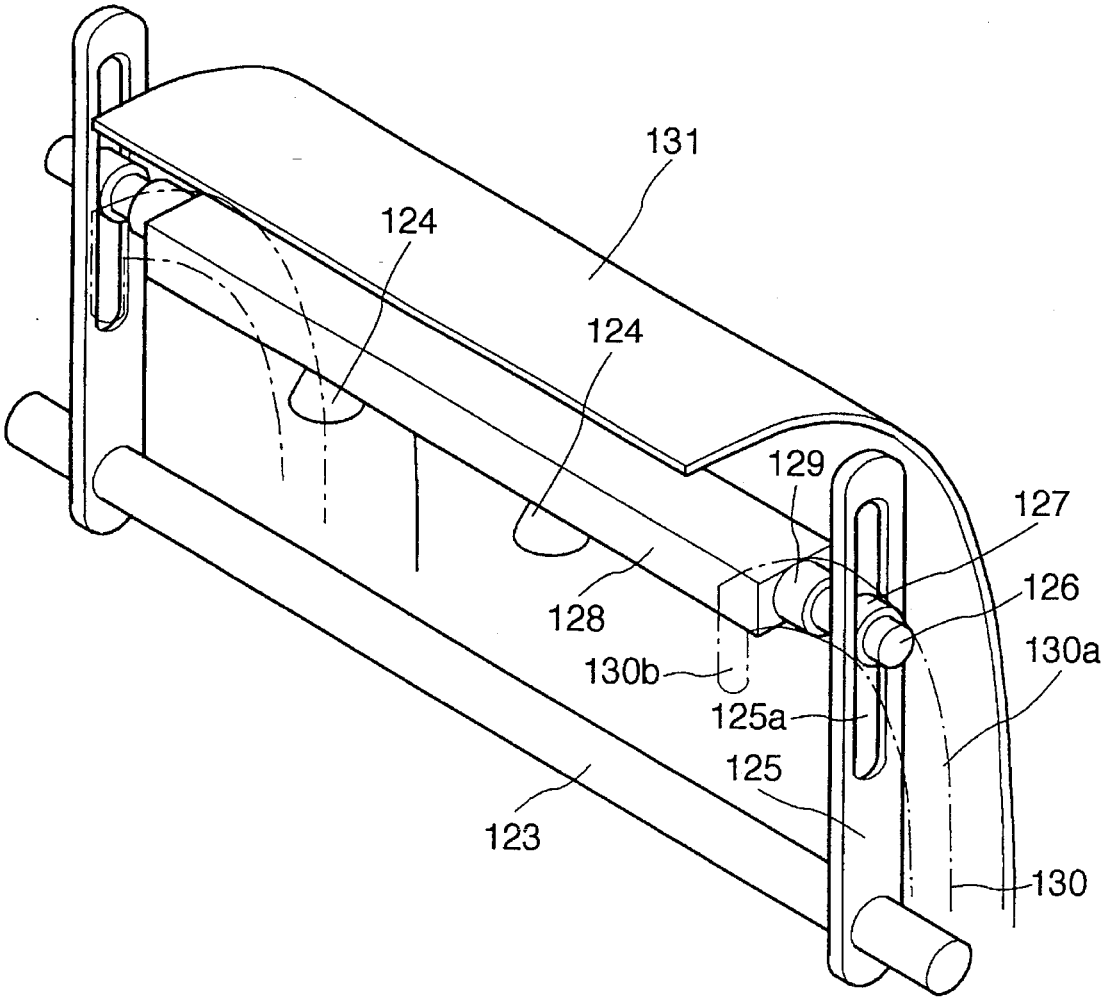
FIG. 36 is a perspective view of a sucker driving mechanism portion.

Referring now to FIG. 36 which is a perspective view of a driving mechanism portion for the suction unit 124, an arm 125 formed with a slot 125*a* is fixed to the shaft 123 rotatable by a drive source, not shown. A rolling bearing 127 provided on a guide shaft 126 is loosely fitted in the slot 125*a* for movement along the slot 125*a*, and a suction unit mounting plate 128 having the suckers 124 fixed thereto is fixed to the guide shaft 126. The guide shaft 126 is inhibited from rocking by any angle greater than a predetermined angle by a member, not shown.

Further, a rolling bearing 129 is provided on the guide shaft 126 and is loosely fitted for movement along a guide hole 130 formed in a side plate, not shown. This guide hole 130 comprises an arcuate portion 130*a* extending over approximately 180°, and straight portions 130*b* and 130*c* formed in the opposite end portions of the arcuate portion 130*a*, and an arcuate guide plate 131 is provided outside the arcuate portion 130*a*.

An arcuate guide plate 132 is also provided inside the arcuate portion 130*a* of the guide hole 130, and two pairs of sub scanning rollers 133 and 134 spaced apart by a certain interval from each other are provided at the left of the lower portion of the arcuate guide plate 132. A guide plate 135, a pair of vertically movable conveying rollers 136, a guide plate 137, a pair of conveying rollers 138 and a guide plate 139 are arranged in succession forwardly of the sub scanning rollers 134.

Further, an optical system unit 142 provided with a laser source 140 and a polygon mirror or the like and a mirror 141 is provided above the sub scanning rollers 133 and 134 so that a beam of light emitted from the laser source 140 may be reflected by the mirror 141 and enter the gap portion between the sub scanning rollers 133 and 134.

Figure 37:
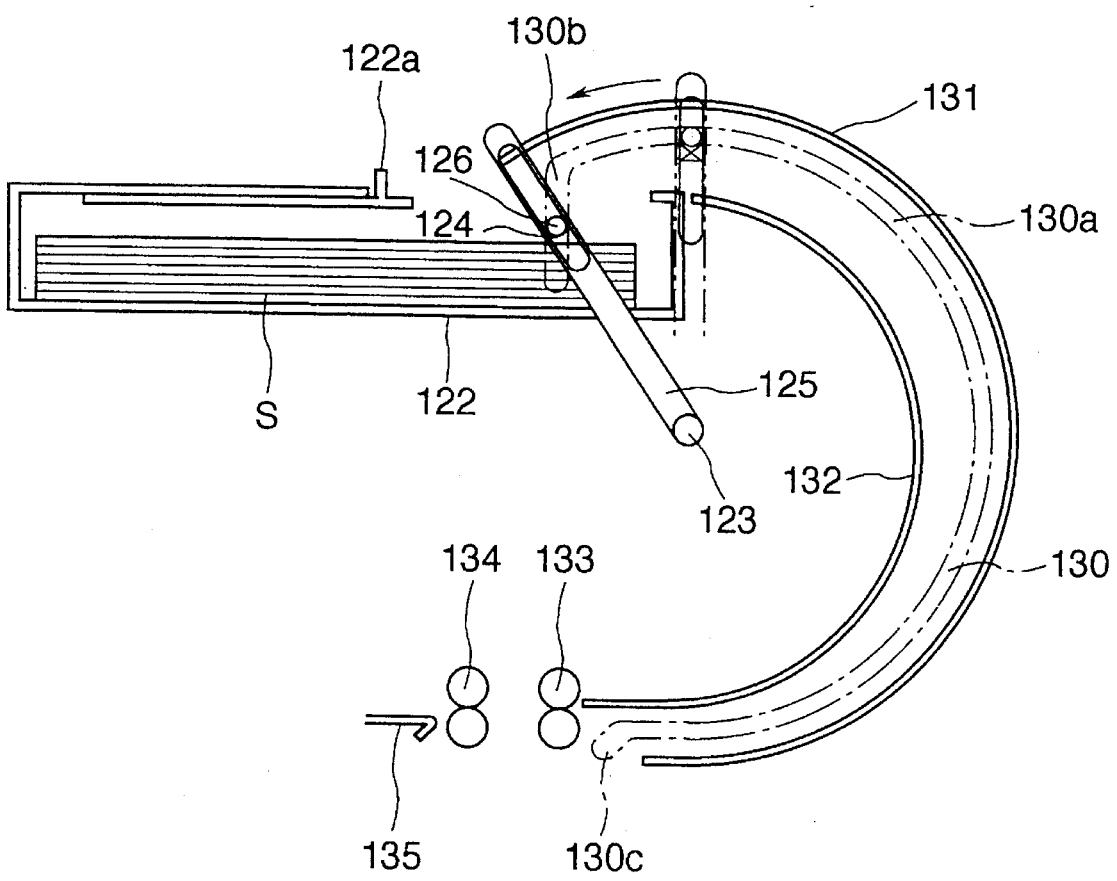
FIG. 37 is an illustration of the sucker driving mechanism.

The procedure by which the sheet S is conveyed will now be described with reference to FIGS. 37 to 42. As shown in FIG. 37, the arm 125 is first pivotally moved counterclockwise, and the guide shaft 126 is moved downward in accordance with the guide of the straight portion 130*b* of the guide hole 130 and the slot 125*a* in the arm 125, and the suction unit 124 sucks the uppermost one of the sheets S by the sucking operation of an air pump, not shown.

Figure 38:
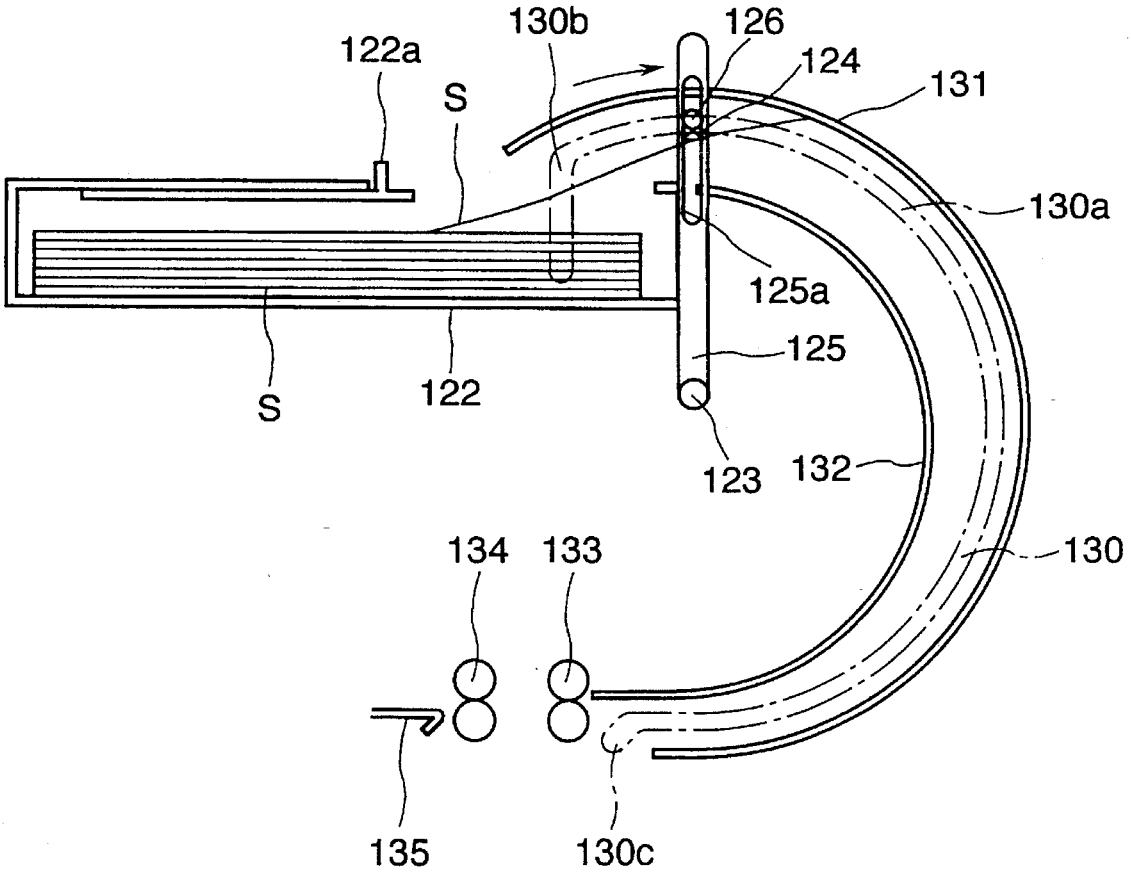
FIG. 38 is an illustration of the sucker driving mechanism.
Figure 39:
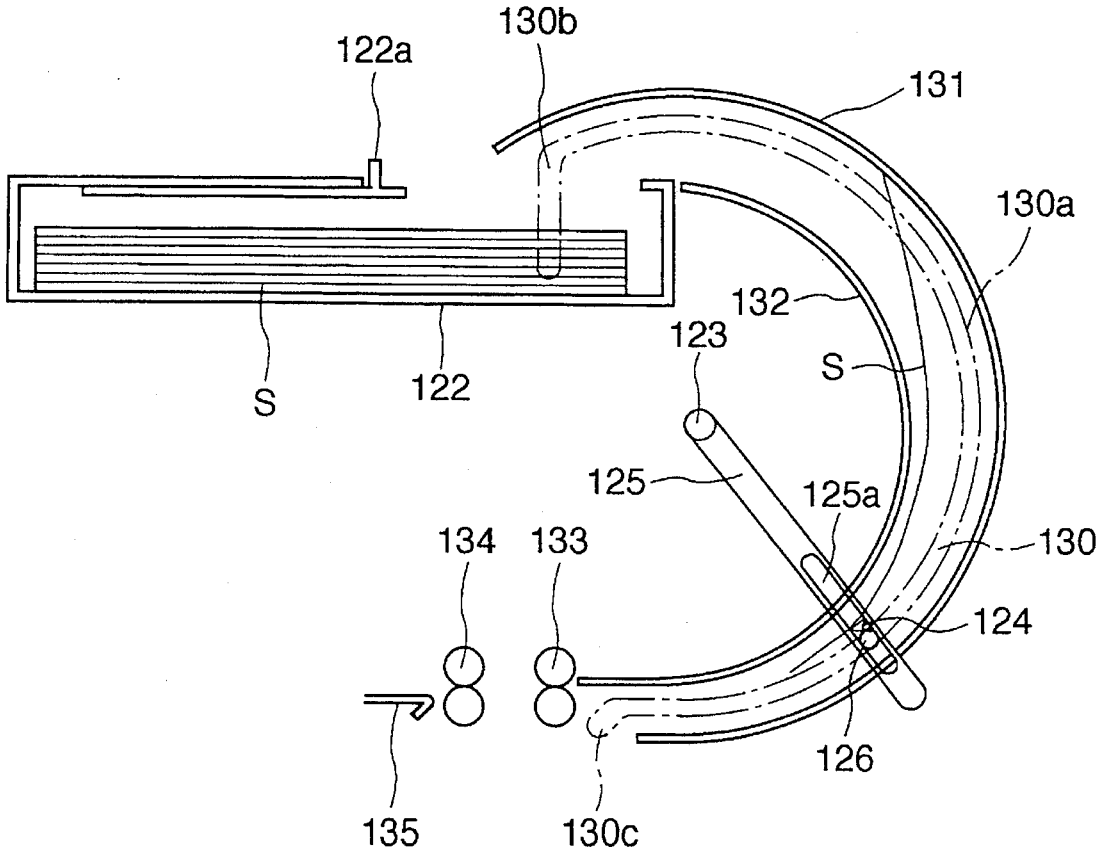
FIG. 39 is an illustration of the sucker driving mechanism.
Figure 40:
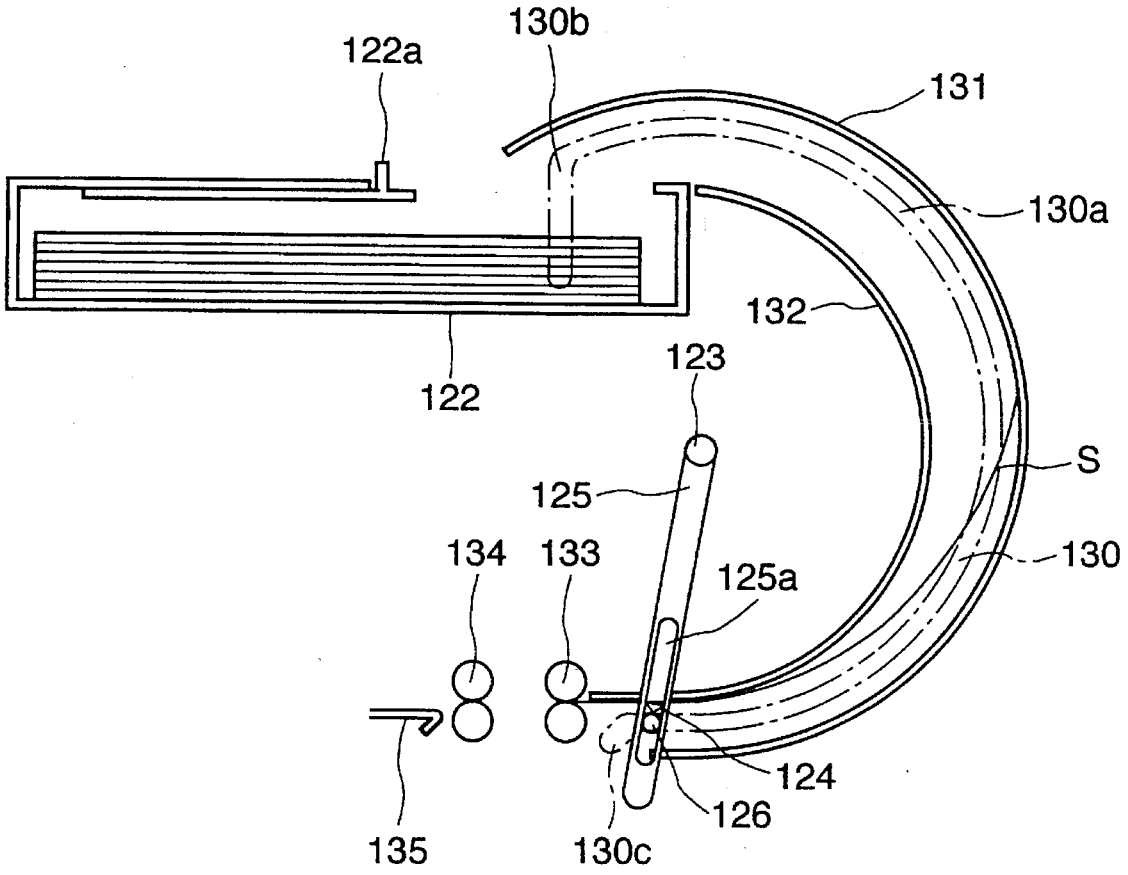
FIG. 40 is an illustration of the sucker driving mechanism.
Figure 41:
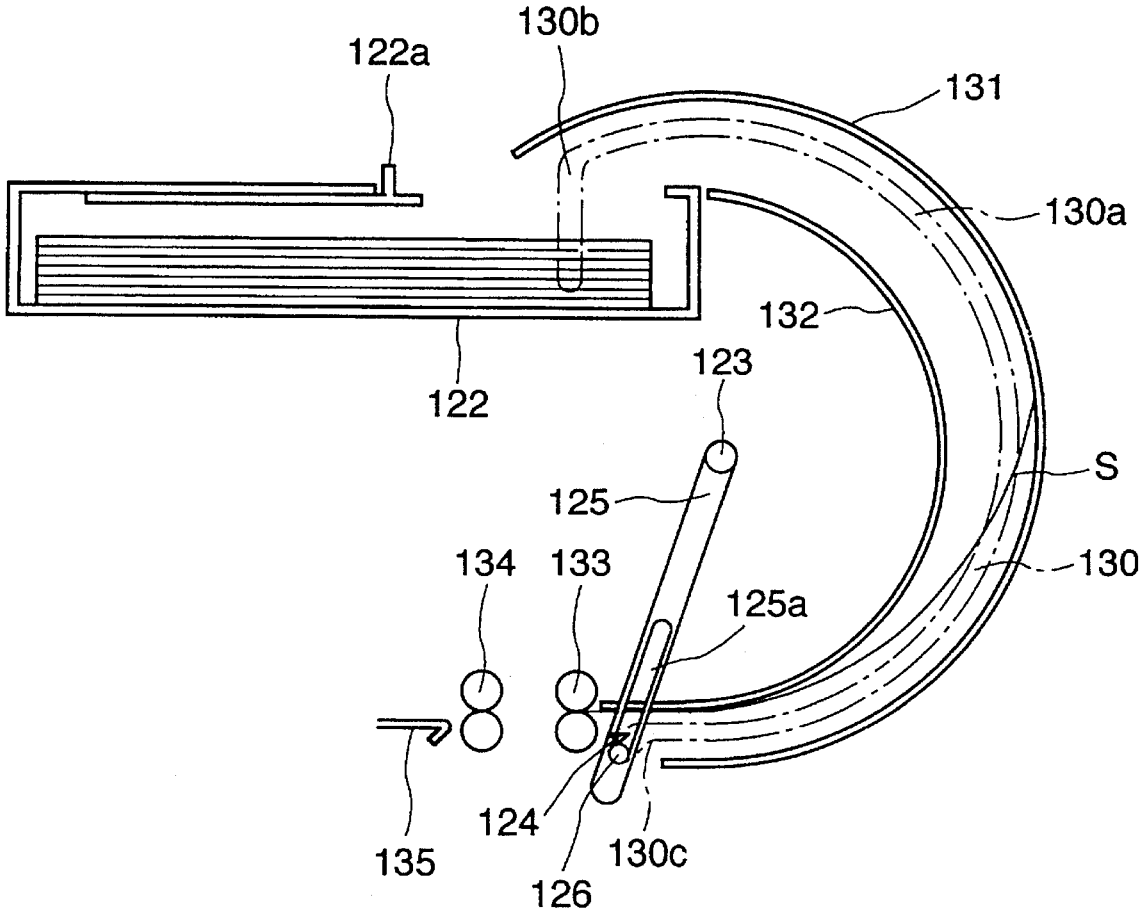
FIG. 41 is an illustration of the sucker driving mechanism.

Subsequently, as shown in FIGS. 38 and 39, the arm 125 is pivotally moved clockwise, and the guide shaft 126 is moved to the lower end of the arcuate portion 130*a* as shown in FIG. 40, and the leading end of the sheet S is inserted into the nip between the sub scanning rollers 133, whereafter the arm 125 is stopped and at the same time, the sucking operation of the air pump is also stopped.

Figure 42:
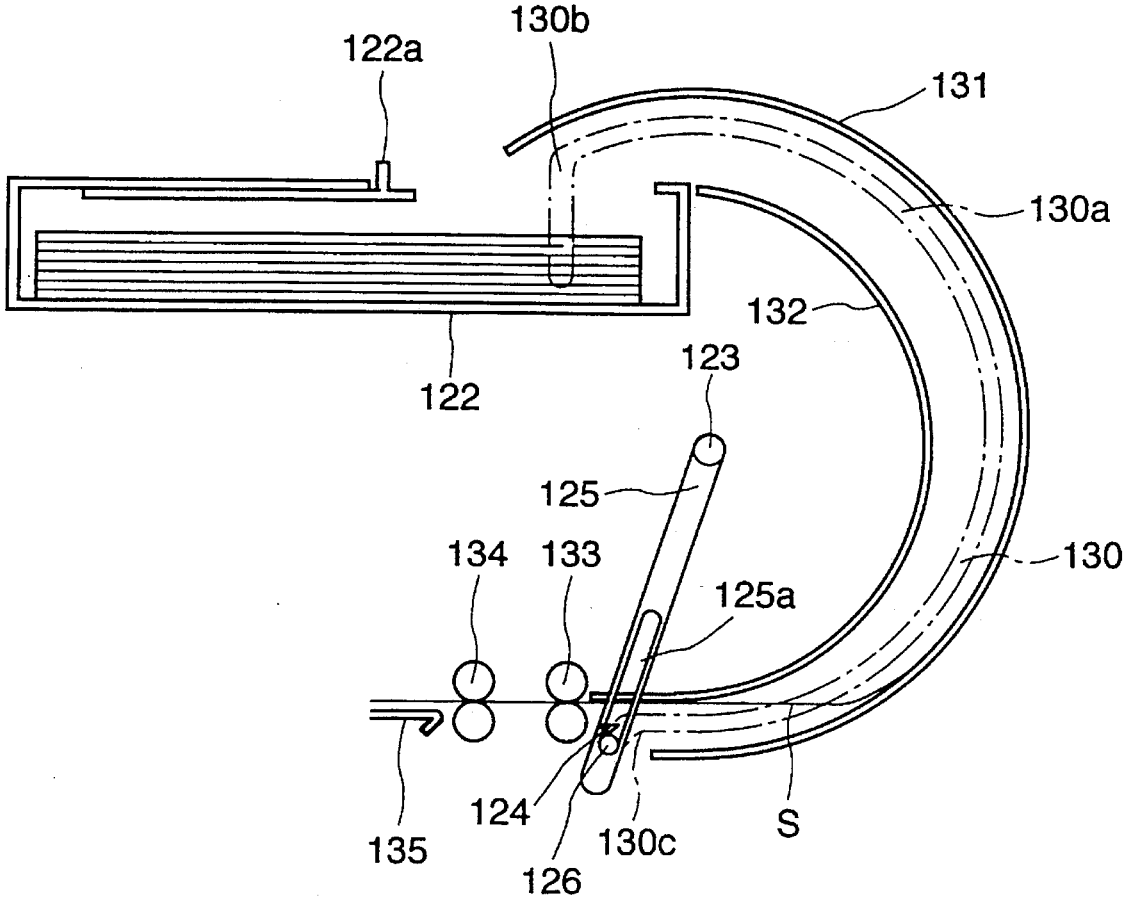
FIG. 42 is an illustration of the sucker driving mechanism.

Then, as shown in FIG. 41, the arm 125 is again pivotally moved clockwise to thereby move the suction unit 124 to the left end of the straight portion 130*c* of the guide hole 130 and retract it from the conveyance path. Thereafter, as shown in FIG. 42, the sub scanning rollers 133 and 134 are rotated to thereby convey the sheet S at a constant speed and effect sub scanning and at the same time, the main scanning by the optical system unit 142 is effected, whereby a latent image is recorded on the sheet S. At this time, the sheet S is moved with its trailing end being in contact with the guide plate 131, whereby the load during conveyance can be made small as in the eighth embodiment. Lastly, the sheet S is conveyed on the guide plates 135, 137 and 139 and to an automatic developing device by the action of the pairs of conveying rollers 136 and 138.

While in the present embodiment, two pairs of sub scanning rollers 133 and 134 are used, a pair of sub scanning rollers if used as in the seventh embodiment will constitute no hindrance.

Figure 43:
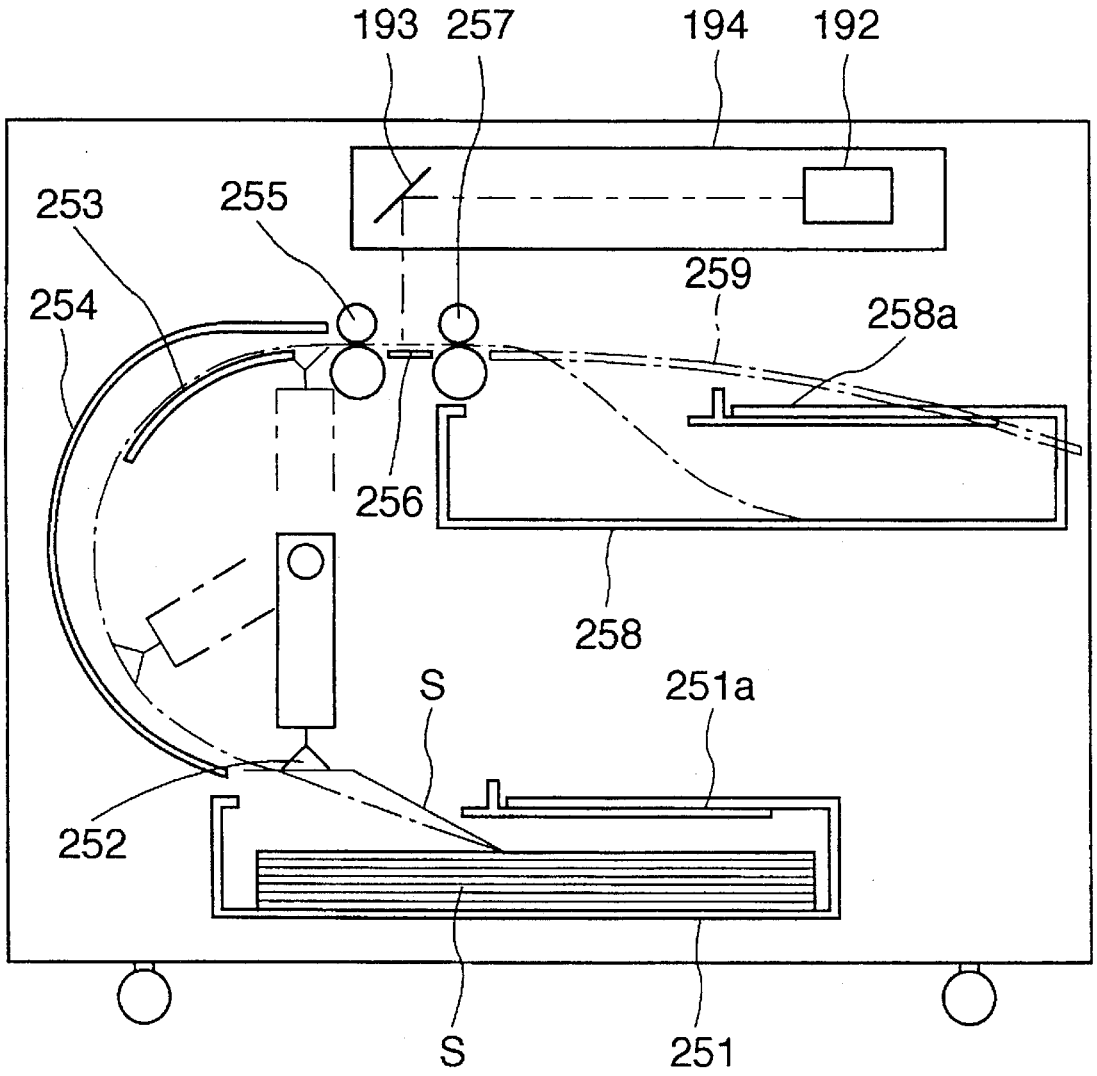
FIG. 43 shows the construction of a tenth embodiment of the present invention.

FIG. 43 shows the construction of a tenth embodiment of the present invention. In this embodiment, a suction unit 252 is provided above a supply magazine 251, and guide plates 253 and 254 are provided on the inside and outside, respectively, along the rotation orbit of the suction unit 252. A guide plate 256 and a pair of sub scanning rollers 257 are provided at the right of a pair of sub scanning rollers 255, and a receive magazine 258 provided with a sliding slid 258*a* is provided below the right of the sub scanning rollers 257.

A sheet S is inserted into the nip between the sub scanning rollers 255 and sub scanning is effected at a constant speed by the rotation of the sub scanning rollers 255 and at the same time, the main scanning by a laser source 192 is effected on the guide plate 256, whereby a latent image is recorded on the sheet S. Subsequently, the sheet S is further conveyed to right by the sub scanning rollers 257 and is received gradually its leading end into the receive magazine 258. When the trailing end of the sheet S leaves the sub scanning rollers 257, the sheet S falls from gravity and is fully received into the receive magazine 258.

In this manner, the elimination of a pair of conveying rollers becomes possible and costs can be reduced and also, the supply magazine 251 and receive magazine 258 can be provided closely adjacent to each other and therefore, the height of the device can be made smaller than in the sixth embodiment.

When the sheet S is to be automatically conveyed to an automatic developing device, a rightwardly downwardly inclined guide plate 259 can be provided forwardly of the sub scanning rollers 257 without the receive magazine 258 being provided. Also, the magnitude of this inclination may be such that after the trailing end of the sheet S leaves the sub scanning rollers 257, the sheet S slides on the guide plate 259 from gravity and arrives at conveying rollers provided in the automatic developing device.

In the above-described sixth to tenth embodiments, the optical system unit for image recording may be replaced by a unit for effecting image reading similarly by light beam scanning.

As described above, the image recording or reading apparatus according to any of the sixth to tenth embodiments can realize compact, inexpensive and stable sheet conveyance by a simple construction, namely, by rotating a suction unit which has sucked a sheet by a sucker driving mechanism, turning the direction of movement of the sheet and conveying the sheet to the main scanning position.

What is claimed is:

1. A sheet supplying device comprising:

a suction unit for sucking a sheet; and suction unit moving means for moving said suction unit, said suction unit moving means having a first moving mechanism for moving said suction unit along a diametrical direction of a rotation around a predetermined rotation axis, and a second moving mechanism for moving said suction unit along a rotation direction around said rotation axis, at least a part of said first moving mechanism being provided on said second moving mechanism, and being rotated around said rotation axis by said second moving mechanism so that said suction unit substantially turns around the rotation axis.

2. A device according to claim 1, wherein said first moving mechanism is of a construction in which the opposite end portions of two arm mechanisms each having two arms having their one end portion pivotally connected together are brought into meshing engagement with each other by a gear.

3. A device according to claim 1, wherein said first moving mechanism has a screw feed mechanism.

4. A device according to claim 1, wherein said first moving mechanism has an arm mechanism and a guide slot mechanism for diametrically displacing said arm mechanism correspondingly to the second movement by said circumferentially moving mechanism.

5. A device according to claim 1, wherein said first moving mechanism has an arm formed with a slot, a suction unit supporting member slidably fitted and supported in said slot, and a guide slot mechanism for diametrically displacing said suction unit supporting member correspondingly to the circumferential movement by said second moving mechanism.

6. A device according to claim 1, wherein said suction unit moving means further has angle varying means for varying the angle of said suction unit with respect to said sheet.

7. A device according to claim 1, further having a common drive source for driving both of said first moving mechanism and said second moving mechanism.

8. A device according to claim 1, further having sheet separating means cooperating with said first moving mechanism to separate the sheet sucked by said suction unit from other stacked sheets.

9. A device according to claim 1, wherein said first moving mechanism is substantially all provided on said second moving mechanism.

10. A sheet supplying device comprising:

a suction unit for sucking a sheet; and suction unit moving means for moving said suction unit, said suction unit moving means having a first moving mechanism for moving said suction unit along a diametrical direction of a rotation around a predetermined rotation axis, and a second moving mechanism for moving said suction unit along a rotation direction around said rotation axis, at least a part of said first moving mechanism being provided on said second moving mechanism, and being rotated around said rotation axis by said second moving mechanism so that said suction unit substantially turns around the rotation axis, wherein said first moving mechanism has an arm mechanism provided with two arms having their centers pivotally connected together and having their one end disposed on a suction unit side and their other ends disposed on a rotation axis side.

11. An apparatus for effecting a recording or reading process on a sheet, comprising:

sheet processing means for effecting a recording or reading process on the sheet;

conveying means for conveying the sheet to said sheet processing means; and sheet removing means for removing the sheet from a station in which the sheet is contained in order to convey the sheet by said conveying means, said sheet removing means having a suction unit for sucking the sheet, and suction unit moving means for moving said suction unit, wherein said suction unit moving means has a first moving mechanism for moving said suction unit along a diametrical direction of a rotation around a predetermined rotation axis, and a second moving mechanism for moving said suction unit along a rotation direction around said rotation axis, at least a part of said first moving mechanism being provided on said second moving mechanism, and being rotated around said rotation axis by said second moving mechanism so that said suction unit substantially turns around the rotation axis.

12. An apparatus according to claim 11, further having sheet guide means provided on a conveyance path of the sheet.

13. An apparatus according to claim 12, wherein said sheet guide means has a guiding member curved with a predetermined curvature.

14. An apparatus according to claim 11, wherein the direction of conveyance of the sheet by said conveying means are turned 90° or greater.

15. An apparatus according to claim 11, wherein said conveying means executes the sub scanning of the sheet during the sheet processing by said sheet processing means.

16. An apparatus according to claim 11, further having a processed sheet receiving portion downstream of said sheet processing means.

17. An apparatus according to claim 11, wherein said first moving mechanism is substantially all provided on said second moving mechanism.

* * * * *

UNITED STATES PATENT AND TRADEMARK OFFICE

CERTIFICATE OF CORRECTION

PATENT NO. : 5,560,596

DATED : October 1, 1996

INVENTOR(S) : OKODA et al.

It is certified that error appears in the above-indentified patent and that said Letters Patent is hereby corrected as shown below:

Title page

[56] References Cited

Change "Muller" to --Müller--.

[57] ABSTRACT

Line 3, delete "unit" (first occurrence);

delete "sucker".

Line 4, delete "unit" (first occurrence);

Line 5, delete "unit" (first occurrence);

Line 6, delete "unit" (first occurrence);

Line 8, delete "unit" (first occurrence);

COLUMN 1

Line 23, change "sucker 3" to --suction unit 3--.

COLUMN 4

Line 14, change "sucker" to --suction unit--;

Line 41, change "sucker" to --suction unit--;

Line 43, change "sucker" to --suction unit--;

COLUMN 5

Line 28, change "sucker" to --suction unit--;

Line 47, change "sucker" to --suction unit--;

Line 52, change "sucker" to --suction unit--.

COLUMN 6

Line 11, change "suckers" to --suction units--.

Line 47, change "sub scanning" to --sub-scanning--.

COLUMN 7

Line 7, change "sucker" to --suction unit--;

UNITED STATES PATENT AND TRADEMARK OFFICE

CERTIFICATE OF CORRECTION

PATENT NO. : 5,560,596

DATED : October 1, 1996

INVENTOR(S) : OKODA ET AL.

It is certified that error appears in the above-indentified patent and that said Letters Patent is hereby corrected as shown below:

COLLUMN 7 (cont'd)

Line 10, change "sucker" to --suction unit--;
Line 11, change "sucker 152" to --suction unit 152--;
Line 13, change "sucker 152" to --suction unit 152--;
Line 36, change "sucker" to --suction unit--;
Line 37, change "sucker" to --suction unit--;
Line 39, change "sucker" to --suction unit--;
Line 40, change "sucker" to --suction unit--;
Line 49, change "sucker" to --suction unit--;
Line 50, change "suckers 152" to --suction units 152--;

COLUMN 8

Line 59, change "sucker 182" to --suction unit 182--.

COLUMN 9

Line 20, change "sucker 182" to --suction unit 182--;
Line 65, change "sucker" to --suction unit--;
Line 67, change "sucker" to --suction unit--.

COLUMN 10

Line 15, change "sucker" to --suction unit--.
Line 31, change "sucker 112" to --suction unit 112--.

COLUMN 11

Line 7, change "sucker 124" to --suction unit 124--;
Line 15, change "suckers 124" to --suction units 124--.

UNITED STATES PATENT AND TRADEMARK OFFICE

CERTIFICATE OF CORRECTION

PATENT NO. : 5,560,596 Page 3 of 3

DATED : October 1, 1996

INVENTOR(S) : OKODA ET AL.

It is certified that error appears in the above-indentified patent and that said Letters Patent is hereby corrected as shown below:

COLUMN 12

Line 55, change "sucker" to --suction unit--.

COLUMN 13

Line 18, change "second" to --circumferential--;

Line 19, change "circumferentially" too --second--.

Signed and Sealed this

Third Day of June, 1997

*Attest:*

*Attesting Officer*

Bruce Lehman

BRUCE LEHMAN

*Commissioner of Patents and Trademarks*